US011828483B1

(12) United States Patent
Batarseh

(10) Patent No.: US 11,828,483 B1
(45) Date of Patent: Nov. 28, 2023

(54) SUPPORT BYPASS VENT

(71) Applicant: Adel Issa Batarseh, Brea, CA (US)

(72) Inventor: Adel Issa Batarseh, Brea, CA (US)

( * ) Notice: Subject to any disclaimer, the term of this patent is extended or adjusted under 35 U.S.C. 154(b) by 0 days.

(21) Appl. No.: 17/821,099

(22) Filed: Aug. 19, 2022

(51) Int. Cl.
*F24F 13/02* (2006.01)

(52) U.S. Cl.
CPC ..... *F24F 13/0227* (2013.01); *F24F 13/0254* (2013.01)

(58) Field of Classification Search
CPC ..... F24F 13/0254; F24F 13/0227; F16L 55/1286; F16L 41/03; F16L 41/025; F16L 41/023
USPC ..... 454/14
See application file for complete search history.

(56) References Cited

PUBLICATIONS

Flat Duct Channel Connector (Avaliable on Amazon beginning Aug. 29, 2021. https://www.amazon.com/dp/B09DXL3JS9/ref=sspa_dk_detail_6?pd_rd_w=tJgD2&content-id=amzn1.sym.af9528d2-09ba-47ee-b909-59e3022bebe1&pf_rd_p=af9528d2-09ba-47ee-b909-59e3022bebe1&pf_rd_r=KYSJA8QA7XYH2V8H2R40&pd_rd_wg=5wiFw&pd_rd_r=4c9eff90-6d2f-4.*

Verplas Radial Duct Plenum (First published on Jul. 26, 2016 per Wayback Machine).https://www.verplas.co.uk/product/radial-ducting-plenum-complete-with-x-2-connections-6/.*

Screenshot of the Wayback machine results for Verplas Radial Duct Plenum.https://web.archive.org/web/20160701000000*/https://www.verplas.co.uk/product/radial-ducting-plenum-complete-with-x-2-connections-6/.*

* cited by examiner

*Primary Examiner* — Vivek K Shirsat
(74) *Attorney, Agent, or Firm* — CIONCA IP Law P.C.; Marin Cionca

(57) ABSTRACT

A support bypass vent having: a beam pass vent having: central body portion with two opposite ends and a hollow center; a terminal end portion associated with each opposite end of the central body portion; a plurality of screw plates associated with the central body portion; at least one adapter port nested within each terminal end portion; and a ventilation line adapter configured to engage with each terminal end portion by engaging with a corresponding adapter port; wherein each ventilation line adapter is further configured to engage with a corresponding ventilation line such that air is configured to travel through the support bypass vent. By utilizing a support bypass vent with a central body portion having a lesser thickness as part of a ventilation system, the support bypass vent may provide a ventilation pathway around a support structure without significantly increasing the resultant wall thickness covering the support structure.

19 Claims, 17 Drawing Sheets

SUPPORT BYPASS VENT

BACKGROUND OF INVENTION

1. Field of the Invention

The invention relates generally to ventilation structures and specifically to ventilation structures configured to bypass support structures.

2. Description of the Related Art

In the construction industry, in order to suitably allow an air vent to traverse from the ground to the roof of a structure, while remaining enclosed within the walls, it may be necessary to cut into the beam, header, support post or other support structure to provide said air vent with a pathway. One consequence of this is that the support structure that is cut into has reduced structural integrity, which may compromise the stability of the structure it is used within. One potential method of avoiding cutting into a support structure, while still allowing an air vent to travel as needed may utilize of an air admittance valve (AAV valve). However, the usage of AAV valves is banned in most states, as a result of said AAV valves being spring loaded and not up to code in many instances.

Therefore, there is a need to solve the problems described above by providing a pass vent that may allow a ventilation system to bypass a support structure while avoiding compromising the integrity of said support structure, while simultaneously abiding by established building codes.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a support bypass vent is provided, the support bypass vent comprising: a beam pass vent having: a central body portion having two opposite ends and a hollow inner cavity disposed between the two opposite ends; two tapered terminal end portions, each tapered terminal end portion having a narrow end directly attached to the corresponding opposite end of the central body portion, wherein each terminal end portion is angled with respect to the central body portion; a plurality of screw plates associated with the central body portion, wherein each screw plate is configured to house a securing screw, wherein each securing screw is configured to secure the beam pass vent to a support structure; a plurality of adapter ports nested within each tapered terminal end portion; and two ventilation line adapters, each ventilation line adapter being configured to engage with a corresponding tapered terminal end portion by being nested within a corresponding adapter port; wherein each ventilation line adapter is further configured to engage with a corresponding ventilation line. Thus, an advantage is that a ventilation system utilizing the disclosed support bypass vent may allow air to travel around a support structure without needing to drill through the support structure or otherwise damage it. This in turn allows for the structural stability of the support structure to be maintained while allowing a ventilation system to bypass it. Another advantage is that the support bypass vent may be easily customizable, allowing the same support bypass vent to be used in multiple situations through selective usage of its various elements, including additional adapter ports and port caps. Another advantage is that the central body portion may be less than a half inch thick, thus allowing the support bypass vent to go around a support structure without significantly increasing its resultant thickness, thus allowing overlaying material, such as drywall to not be affected significantly by its implementation. Another advantage is that each terminal end portion may be configured to engage with more than one ventilation line of a ventilation system, thus allowing the support bypass vent to operate as a splitter within the ventilation system as needed.

In another aspect, a support bypass vent is provided, the support bypass vent comprising: a beam pass vent having: a central body portion having two opposite ends and a hollow inner cavity disposed between the two opposite ends; a terminal end portion associated with each opposite end of the central body portion, wherein each terminal end portion is angled with respect to the central body portion; at least one adapter port nested within each terminal end portion; and a ventilation line adapter configured to engage with each terminal end portion by engaging with a corresponding adapter port; wherein each ventilation line adapter is further configured to engage with a corresponding ventilation line. Again, an advantage is that a ventilation system utilizing the disclosed support bypass vent may allow air to travel around a support structure without needing to drill through the support structure or otherwise damage it. This in turn allows for the structural stability of the support structure to be maintained while allowing a ventilation system to bypass it. Another advantage is that the support bypass vent may be easily customizable, allowing the same support bypass vent to be used in multiple situations through selective usage of its various elements, including additional adapter ports and port caps. Another advantage is that the central body portion may be less than a half inch thick, thus allowing the support bypass vent to go around a support structure without significantly increasing its resultant thickness, thus allowing overlaying material, such as drywall to not be affected significantly by its implementation. Another advantage is that each terminal end portion may be configured to engage with more than one ventilation line of a ventilation system, thus allowing the support bypass vent to operate as a splitter within the ventilation system as needed.

In another aspect, a support bypass vent is provided, the support bypass vent comprising: a beam pass vent having: a central body portion having two opposite ends and a hollow inner cavity disposed between the two opposite ends; a terminal end portion associated with each opposite end of the central body portion, wherein each terminal end portion is angled with respect to the central body portion; and an adapter port nested within each a terminal end portion. Again, an advantage is that a ventilation system utilizing the disclosed support bypass vent may allow air to travel around a support structure without needing to drill through the support structure or otherwise damage it. This in turn allows for the structural stability of the support structure to be maintained while allowing a ventilation system to bypass it.

Another advantage is that the support bypass vent may be easily customizable, allowing the same support bypass vent to be used in multiple situations through selective usage of its various elements, including additional adapter ports and port caps. Another advantage is that the central body portion may be less than a half inch thick, thus allowing the support bypass vent to go around a support structure without significantly increasing its resultant thickness, thus allowing overlaying material, such as drywall to not be affected significantly by its implementation. Another advantage is that each terminal end portion may be configured to engage with more than one ventilation line of a ventilation system, thus allowing the support bypass vent to operate as a splitter within the ventilation system as needed.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
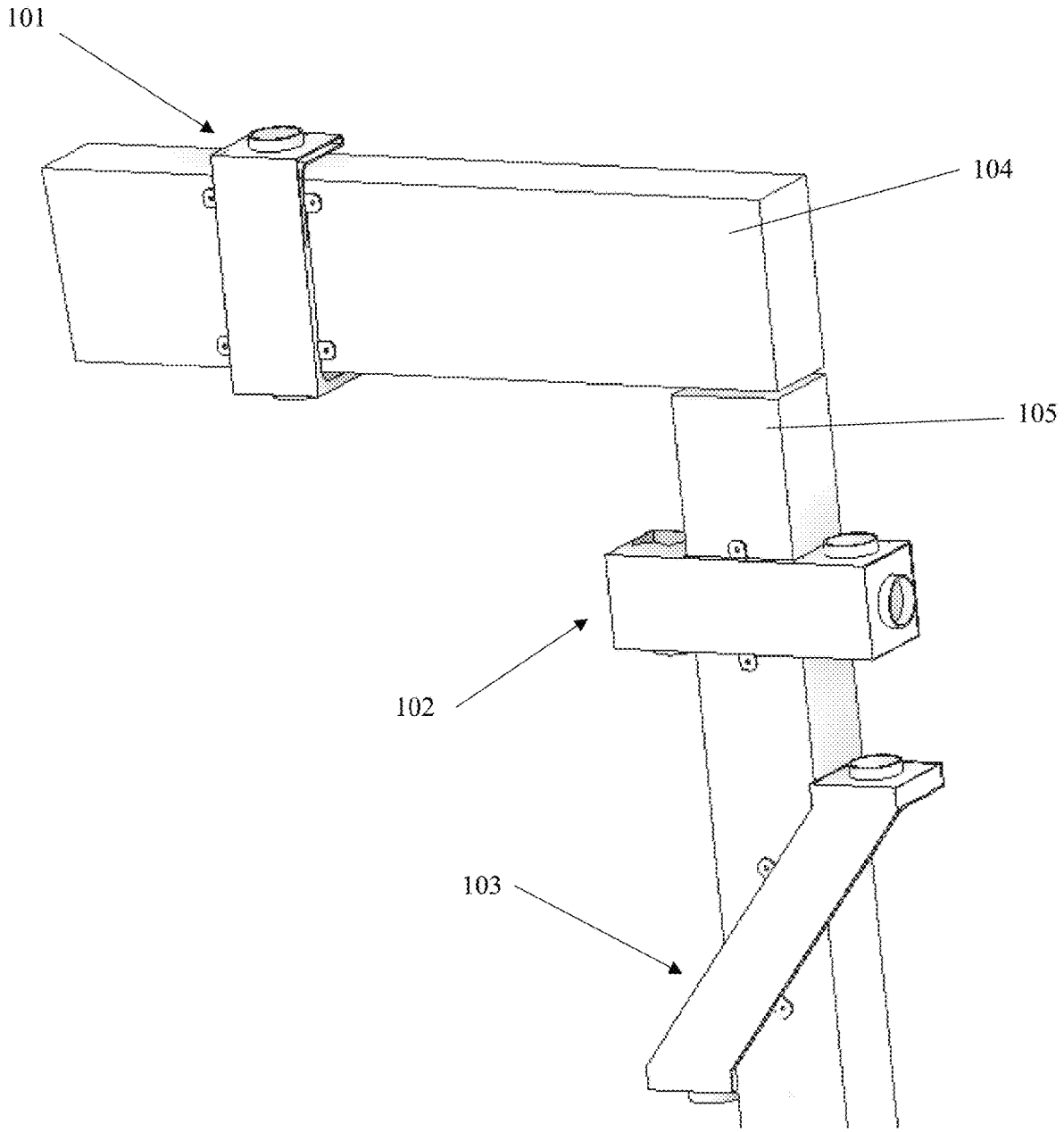
FIG. 1 illustrates the front perspective view of a plurality of beam pass vents secured to corresponding support structures, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 101 and 201, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the front perspective view of a plurality of beam pass vents secured to corresponding support structures, according to an aspect. As can be seen in FIG. 1, there are multiple possible configurations of the disclosed beam pass vents ("BPVs") depending on the type of support structure being bypassed. In order to bypass a horizontally oriented support structure such as a beam ("header") 104, a horizontal beam pass vent ("HBPV") 101 may be implemented. Similarly, in order to bypass a vertically oriented support structure such as a support post ("post", "vertical beam") 105, a flush vertical beam pass vent ("FVBPV") 102 or an angled vertical beam pass vent ("AVBPV") may be implemented, as demonstrated in FIG. 1. Each of the disclosed BPVs may have a hollow center that allows air to flow freely through said BPV to connect ventilation system elements that are otherwise separated by a support structure 104, 105.

The function these disclosed bypass vents and the overall support bypass vent structure is to provide an unobtrusive pathway for ventilation systems flow around, or bypass, support structures, without compromising the integrity of said support structure. As such, the center of each BPV may be hollow. Each beam pass vent and its various elements may be made of acrylonitrile-butadiene-styrene ("ABS"), the same materials as the ventilation lines, or any other suitable material for utilization within a ventilation system. The beam pass vent variants will be discussed in greater detail hereinbelow. The scope of this application may also cover additional beam pass vent variants that may be possible and necessary depending on the support structure to be bypassed and positioning of ventilation lines. It should be understood that the term "ventilation line" may refer to any element of a ventilation system element that may suitably connect to the support bypass vent, such as a ventilation tube, pipe, shaft, etc.

As stated above, correspondingly labeled elements between figures should be understood to be equivalent, unless otherwise stated. Furthermore, elements that share a letter within their label number may also be equivalent structures for their corresponding beam pass vent. For example, the adapter ports 201*f*, 302*f*, 403*f*, 511*f* of FIG.

2A-2D, FIG. 3, FIG. 4, and FIG. 5A-5B, respectively, should be understood to be the same or similar, unless otherwise stated hereinbelow, for compatibility with a corresponding ventilation line adapter. While the disclosed beam pass vents may be depicted herein as only bypassing support structures such as beams, headers, etc., the disclosed beam pass vents may also be used to bypass other structures, such as other supports, lines, ducts, pipes, etc.

Figure 2A:
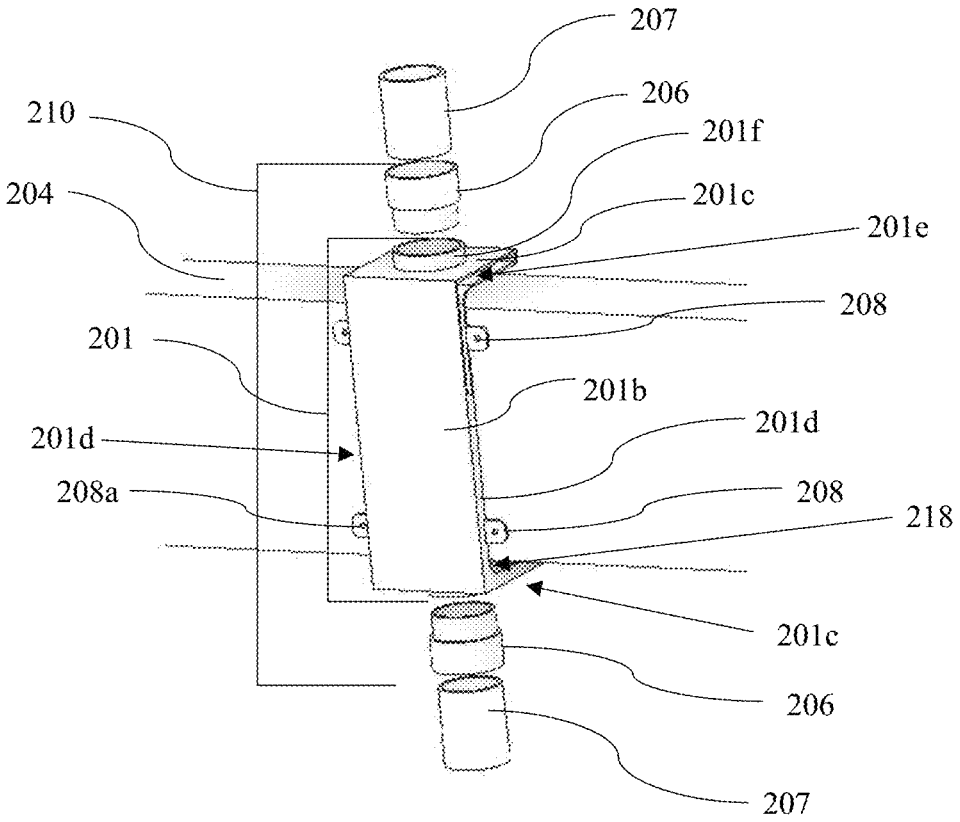
FIG. 2A-2B illustrate exploded, sectional views of a horizontal beam pass vent 201 engaging with a beam 204, according to an aspect.
Figure 2B:
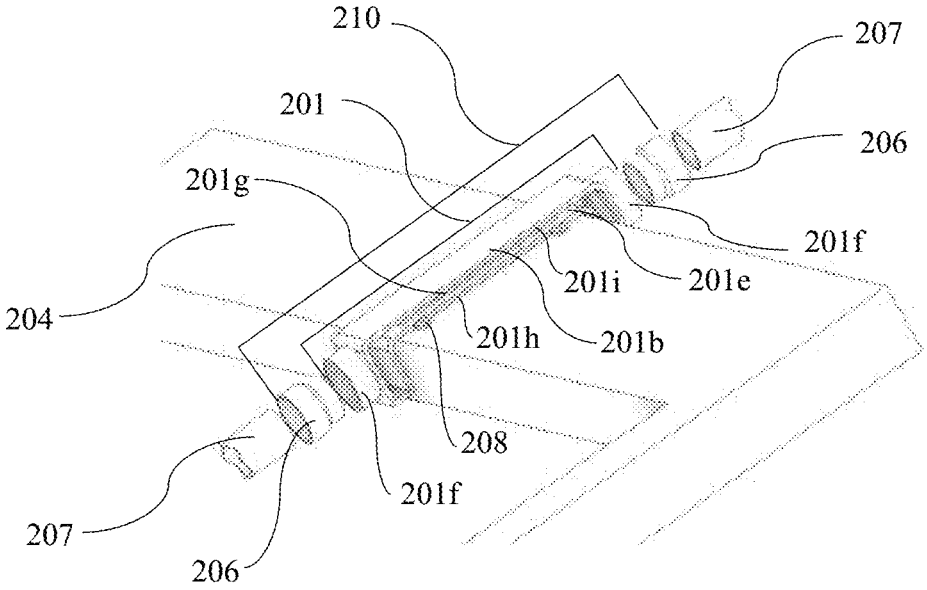
Figure 2C:
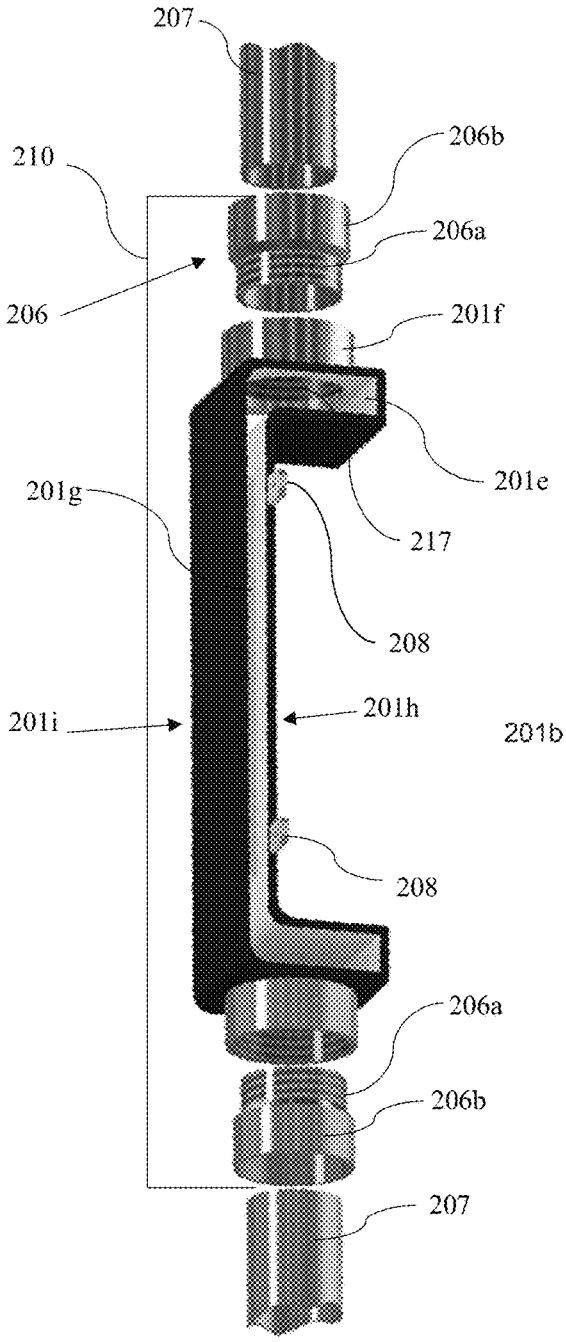
FIG. 2C illustrates the exploded, sectional views of a horizontal beam pass vent 201, according to an aspect.
Figure 2D:
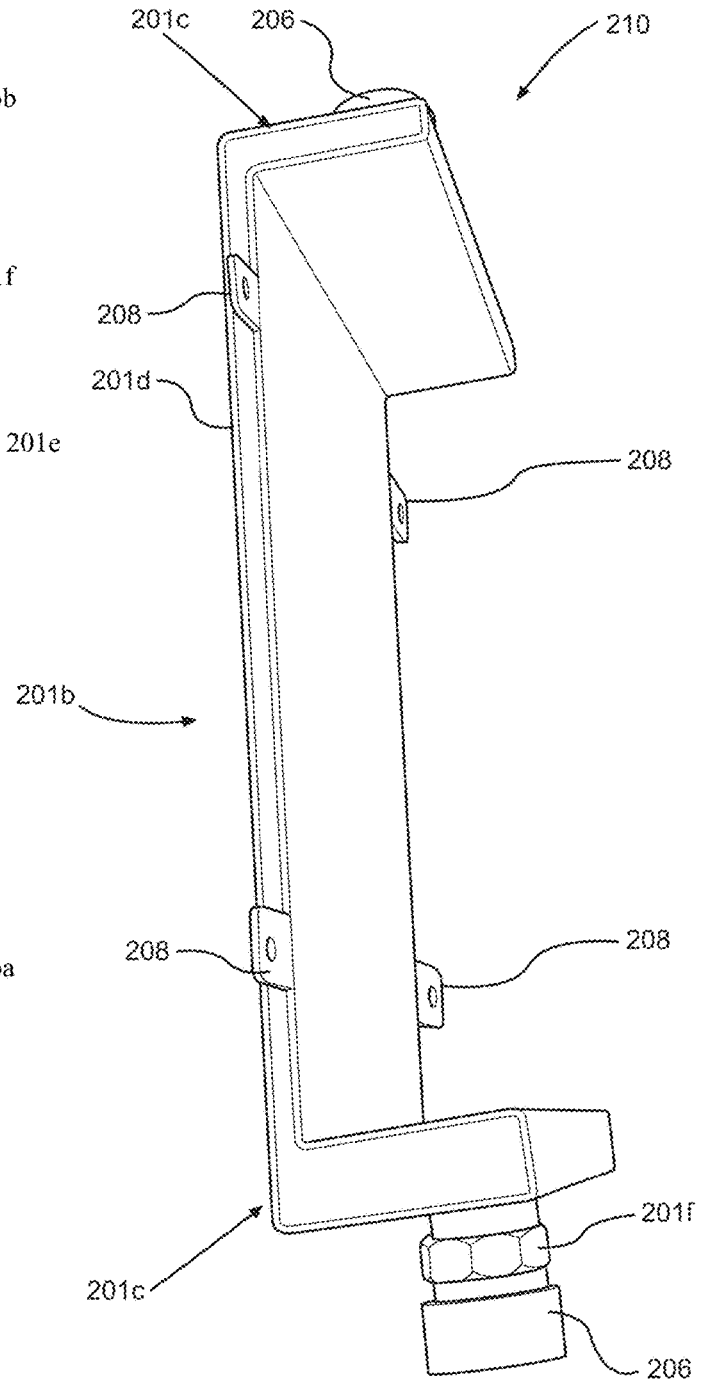
FIG. 2D illustrates a side perspective view of a horizontal beam pass vent 201, according to an aspect.

FIG. 2A-2B illustrate exploded, sectional views of a horizontal beam pass vent 201 engaging with a beam 204, according to an aspect. FIG. 2C illustrates the exploded, sectional view of a horizontal beam pass vent 201, according to an aspect. FIG. 2D illustrates a side perspective view of a horizontal beam pass vent 201, according to an aspect. The disclosed horizontal beam pass vent 201 may be configured to engage with a beam 204 or other applicable support structure in order to allow air to pass around the beam without protruding a significant distance away from said beam 204. The HBPV 201 may be comprised of a central body portion 201*b* disposed between and associated with two terminal end portions ("terminal ends") 201*c*, said HBPV 201 having a hollow inner cavity ("hollow center") 201*e*, wherein each terminal end portion 201*c* has at least one adapter port 201*f* configured to provide a ventilation pathway through said hollow inner cavity 201*e*. In other words, the central body portion 201*b* may have two opposite ends 218, each of which is associated with a corresponding terminal end portion 201*c*. It should be understood that the adapter ports 201*f* for the herein disclosed HBPV 201 embodiment, as well as each other BPV embodiment disclosed herein, may allow air to travel into the hollow inner cavity 201*e* from a terminal end portion 201*c* and out of another, opposite terminal end portion 201*c*, to facilitate the flow of air through the corresponding BPV. As each adapter port 201*f* may open directly into the hollow inner cavity 201*e*, the hollow inner cavity 201*e* may be disposed between the two opposite ends of the central body portion 201*b*, such as opposite ends 518 of FIG. 5.

The central body portion 201*b* may be comprised two sets of parallel faces which form a pipe-like structure with a rectangular or square cross section. The first set of parallel faces may be comprised of an inner plate 201*h* in direct contact with the support structure (e.g., the beam 204) and a parallel, outer plate 201*i*. The second set of parallel faces may be two lateral body ends ("lateral ends") 201*d* which are parallel with each other, perpendicular with the first set of parallel faces and adjoined to the first set of parallel faces (201*h*, 201*i*) to form the aforementioned rectangular cross section. The first set of parallel faces may also be parallel with a surface the beam 204 (e.g., the surface of the support structure that is in contact with the inner plate 201*h*). By making the separation between the first set of parallel faces sufficiently small, the resultant thickness of a wall covering the support structure may be minimized, as described herein.

Each terminal end portion 201*c* may have at least one adapter port 201*f* configured to engage with a corresponding ventilation line adapter 206. Each ventilation line adapter 206 may nest within a corresponding adapter port 201*f* in order to allow air to travel from one ventilation line 207 to another, thus allowing air to bypass a support structure, such as a beam 204. The combination of the HBPV 201 (or any other BPV) with a plurality of ventilation line adapters 206 may be referred to as a support bypass vent 210. Additionally, the HBPV 201 may be further comprised of a plurality of screw plates 208 associated with and extending from the central body portion 201*b*, wherein each screw plate 208 has a screw port 208*a* configured to engage with a securing screw (not shown) in order to fasten the HBPV 201 to the beam 204. The disclosed HBPV 201 of FIGS. 2A-2D may utilize four screw plates 208 extending from the central body portion 201*b* of the HBPV 201, two screw plates 208 extending from each lateral body end 201*d* of the central body portion 201*b*. Alternate embodiments may utilize different quantities and positions of screw plates 208, as long the HBPV 201 may be suitably engaged with or otherwise secured to the beam 204.

It should be understood that while the lateral body ends 201*d* of the HBPV 201 may be depicted as only partially covering the inner cavity 201*e* of the HBPV 201 in FIG. 2A, and completely omitted from FIGS. 2B-2C, each lateral body end 201*d* may be provided as a solid structure that seals the inner cavity 201*e* about the corresponding sides of the HBPV 201, as seen by the lateral body end 201*d* in FIG. 2D. In this way, the inner cavity 201*e* is only accessible via the adapter port 201*f* of each terminal end portion 201*c*. This geometry is consistent with the intended function of the HBPV 201, as well as other BPVs in general. The HBPV 201 (and other BPVs) are configured to allow a ventilation pathway to bypass the structural elements within a wall while maintaining the air seal established by said ventilation pathway.

As can be seen in FIG. 2C, each ventilation line adapter 206 may be comprised of two separate portions: a pass vent adjoining portion 206*a* configured to engage with the BPV, such as HBPV 201, and a ventilation line slot 206*b* configured to engage with a corresponding ventilation line 207. The pass vent adjoining portion 206*a* may be a threaded protrusion, as seen in FIG. 2C, that is configured engage with an internally threaded adapter port 201*f*. As such, each ventilation line adapter 205 may be comprised of a threaded protrusion configured to nest within and engage with a corresponding adapter port 201*f* having a complementary nested thread 217. The ventilation line slot 206*b* may be configured to engage with the corresponding ventilation line 207 through compression, engagement of compatible threaded portions, or any other suitable securing mechanism known in the industry. It should be understood that the HBPV 201, ventilation line adapter(s) 206 and ventilation line(s) 207 may be suitably engaged with each other using other known attachment methods.

In an embodiment, the central body portion 201*b* and each terminal end portion 201*c* of and HBPV 201 may be comprised of a pipe with a square or rectangular cross section, wherein said pipe has a depth of no more than ½ inch with a wall thickness of about ⅛ inch. The depth of the pipe and its wall thickness may be adjusted for compliance with corresponding building codes. The "depth" of the pipe is defined as the distance between the inner plate 201*h* and the outer plate 201*i* of the central body portion 201*b*. Having pipe depth of no more ½ inch will allow for the beam/head or post ("vertical beam") and BPV to be more easily covered with drywall without having to add additional material to the wall in order to cover the BPV adapted support structure. Utilization of the disclosed BPVs within a wall allows for the resultant wall thickness to not be heavily influenced by the presence of a ventilation system running through them. It should be understood that the "length" of the central body portion refers to the distance between the two terminal end portions that it spans, the "width" of the central body refers to the separation between the two lateral body ends 201*d* and the "depth" of the central body portion refers to the separation between the inner plate 201*h* and the outer plate 201*i*.

When determining suitable dimensions for a BPV, the width of the central body portion 201*b* (and the BPV overall)

must be adapted to provide a sufficiently large cross-sectional area within the hollow inner cavity 201*e* of the central body portion to allow for suitable flow rates through the BPV to be achieved despite the narrow depth of the central body portion. Example sizing specifications for an alternative horizontal beam pass vent 811 and an alternative angled vertical beam pass vent 920 are discussed in FIGS. 8A-8D and FIGS. 9A-9D, respectively.

The terminal end portions 201*c* of the pipe may be bent in the same direction to form 90 angles with respect to the central body portion 201*b* thus forming a roughly "U-shaped" structure, as depicted in FIGS. 2A-2D, to allow the body 201*a* to conform to the shape of and seat around a corresponding beam 204 or any other suitable support structure. It should be understood that the disclosed HBPV 201 may simply be rotated to enable functionality of said HBPV 201 with vertical support structures, such a post 105 of FIG. 1, depending on the intended flow direction of the utilized ventilation system. As with all of the herein described BPVs, the hollow center 201*e* of the HBPV 201 may facilitate contained airflow between the two (or more) ventilation lines 207 it bridges.

A brace plate 201*g* may be disposed within the hollow inner cavity 201*e* and attached to the central body portion 201*b*. This brace plate 201*g* may help maintain the rigidity of the body 201*a* of the HBPV, thus ensuring the body 201 is not crushed. Said brace plate 201*g* may be secured to the outer plate 201*i* of the central body portion 201*b*, as seen in FIG. 2B. While the support structure, such a beam 204, may help brace and support the surfaces of the HBPV that are in contact with it, such as the inner plate 201*h* of the central body portion 201*b*, the brace plate 201*g* may help bolster the strength of the outer plate 201*i* by effectively increasing its thickness. Each screw plate 208 may extend from the inner plate 201*h* of the central body portion 201*b*, which is closer to the attached beam 204 than the outer plate 201*i*, such that the distance a securing screw must travel between the screw plate and the beam 204 or other support structure is minimized. It should be noted the securing screws neither negatively nor notably impact the structural integrity of the support structure. It should also be noted that under certain circumstances, the brace plates 201*g* may be omitted from the structure of each BPV, such as when the weight of said BPV is suitably supported by the existing ventilation system infrastructure.

The BPVs disclosed herein may not utilize springs, electronic elements or any active element, and thus require no monitoring nor adjustment. Each BPV may allow for air to flow freely around support structures without any additional user input in a passive operation mode. The passive bypass system enabled by each BPV is ideal for maintaining narrower wall thickness while still allowing ventilation pathways to bypass support structures without modifying or damaging them or adding significant thickness to the corresponding wall. Additional embodiments of BPVs will be discussed hereinbelow.

As disclosed hereinabove, in order to suitably fit between the drywall of a wall structure and the beams/posts of it support structure, the thickness of the central body portion 201*b* (e.g., the separation of the outward facing surfaces of the outer plate 201*i* and the inner plate 201*h*) may need to be minimized while still allowing a sufficiently large cross-sectional area as to not choke air flow through the associated ventilation system. In an embodiment, this thickness of the central body portion 201*b* may be less than ½ inch thick. This thickness may be varied based on the amount of space available between the support structure and the drywall. The thickness of the body portion 201*b* may also be less than ½ inch thick for the hereinbelow disclosed BPV embodiments to ensure that they can be utilized within a comparable ventilation system. In each disclosed BPV embodiment, each terminal end portion 201*c* may be "angled" with respect to central body portion 201*b*. In certain embodiments, such as the HBPV 201 of FIG. 2, each terminal end portion 201*c* of a beam pass vent may be angled to form a 90-degree angle with the central body portion 201*b*, such that the horizontal beam pass vent 201 forms a concave, U-shaped structure that conforms around the shape of the beam 204 or other support structure, minimizing the amount of bulk the beam pass vent forms over the corresponding support structure. In alternative embodiments, each terminal end portion 201*c* may form an angle that is greater than or less than 90 degrees with the central body portion 201*b*, depending on the needs of the application.

While the BPV embodiments disclosed herein may utilize screw plates to engage with the support structure to secure the BPV in place, it should be understood that various attachment methods may be utilized to achieve this. For example, when mounting a BPV to a metallic support structure, alternative attachment methods such as welding, and magnets may also be applied to secure the BPV in place. Depending on the size and shape of the support structure it is mounted against, the BPV may, in an alternative embodiment, utilize clips or clasps to the secure itself on the securing structure. As a result of the BPV being integrated into a ventilation system, and potentially being supported by said ventilation system, some BPV embodiments may be secured in place solely by their connections to elements of the ventilation system, such as the ventilation lines 207.

Further modification may also be made to the disclosed support bypass vent 210 and its various elements to simplify its design. In certain embodiment, the ventilation line adapters 206 may be omitted. In said embodiments, the ventilation lines 207 may engage directly with the beam pass vent 201, such that the ventilation lines 207 nest directly within corresponding adapter ports 201*f*.

Figure 3:
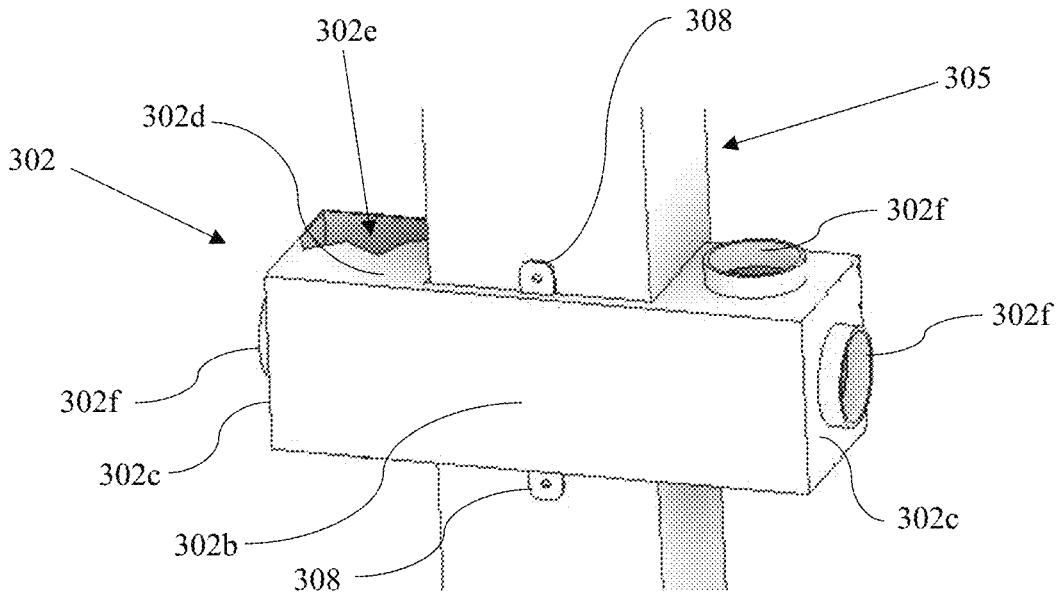
FIG. 3 illustrates the perspective, partial sectional view of a flush vertical beam pass vent 302 engaging with a post, according to an aspect.
Figure 4:
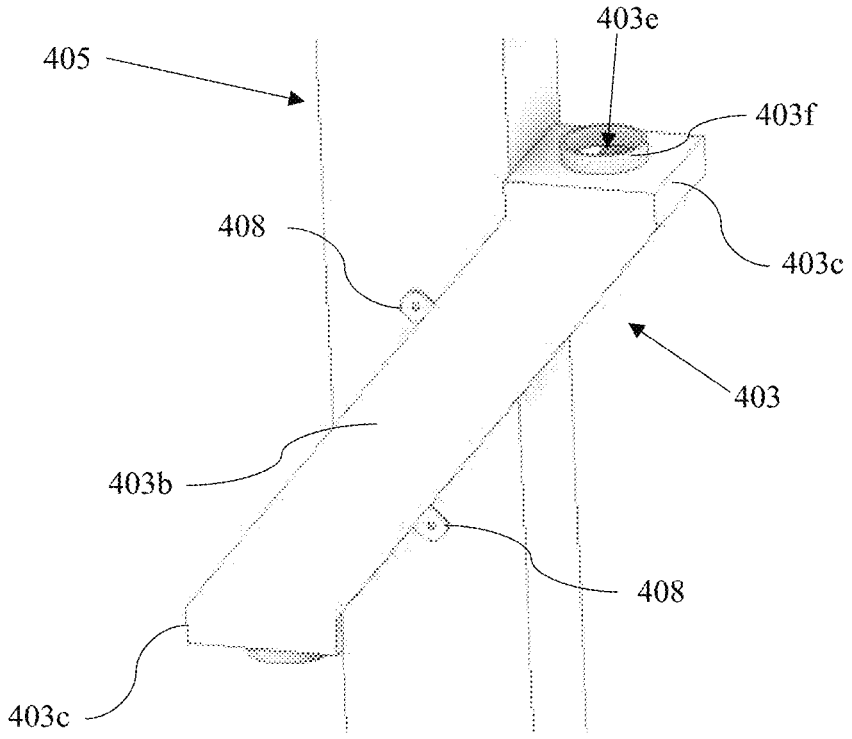
FIG. 4 illustrates the perspective view of the angled vertical beam pass vent 403 engaging with a post, according to an aspect.

FIG. 3 illustrates the perspective, partial section view of a flush vertical beam pass vent 302 engaging with a post 305, according to an aspect. FIG. 4 illustrates the perspective view of the angled vertical beam pass vent 403 engaging with a post 305, according to an aspect. As described previously, there are two potential embodiments of vertical beam pass vents disclosed herein. Each vertical beam pass vent ("VBPV") 302, 403 is configured to allow a ventilation pathway to bypass a vertical support structure, such as a post 305, 405 within a wall construction assembly. Similarly to the prior disclosed HBPV 201 of FIG. 2A, each VBPV 302, 403 may be rotated accordingly to allow it bypass a horizontal support structure, such as the a beam 204. The context in which each disclosed BPV would be used while assembling a ventilation system will be dictated based on the planned or existing ventilation pathways these BPVs are configured to connect, and the support structure being bypassed.

The flush vertical beam pass vent 302 is constructed very similarly to the HBPV 201 of FIG. 2A. Said FVBPV may also be comprised of a central body portion 302*b* disposed between or otherwise associated between two terminal end portions 302*c*. Each of these end portion may have at least one adapter port 302*f* nested within it, such that a ventilation line adapter, such as ventilation line adapter 206 of FIG. 2A, may be utilized to attach the FVBPV to each corresponding ventilation line requiring bypass of the post 305. Similarly to the HBPV 201 of FIG. 2A, the FVBPV 302 may be further comprised of 302*d* lateral ends configured to define and seal the hollow inner cavity 302*e* of the FVBPV 302 when used in conjunction with the central body portion 302*b* and allow the FVBPV 302 to establish a sufficiently air tight connection with the ventilation lines of the ventilation system to maintain proper air flow through said ventilation system. In contrast to the prior disclosed HBPV 201 of FIGS. 2A-2D, the herein disclosed FVBPV 302 may have a plurality of adapter ports 302*f* on each terminal end portion 302*c*. Furthermore, these multiple adapter ports 302*f* may be oriented in different directions (perpendicular or parallel to the central body portion 302*b*) to accommodate differently oriented ventilation pipes. In this way, the FVBPV 302 may be utilized as both a mechanism to bypass a support structure and a mechanism for splitting and/or combing ventilation pathways.

The disclosed FVBPV 302 may also utilize a plurality of screw plates 308 to assist in its engagement with the corresponding post 305. These screw plates 308 may also extend from the lateral ends 302*d* of the central body portion 302*b* of the FVBPV 302. Said screw plates 308 may also be in contact with and parallel to the surface of the post 305 in order to ensure a suitable connection of the FVBPV 302 to the post, upon the engagement of a securing screw with each screw port of each screw plate 308 and the post 305. While the FVBPV embodiment of FIG. 3 may only utilize two total screw plates 308, more or fewer screw plates 308 may be utilized in the securing of a BPV to the support structure. Additionally, the positioning of each screw plate 308 may also be modified. In an alternate embodiment, the screw plates 308 may be secured to each terminal end portion 302*c* and configured to lay flat on an applicable surface of the support structure to allow the FVBPV 302 to be secured to the support structure. Additional embodiments may also use alternate attachment mechanisms, such a clips, adhesives, magnets, etc.

As can be seen in FIG. 4, the angled vertical beam pass vent 403 may also allow a ventilation pathway to bypass a post but may also simultaneously change the height between the entering and exiting ventilation pathways. Such an embodiment of the BPV may be very useful for bypassing a post while utilizing ventilation lines that are both close to and run parallel with the post 405. Unlike previously disclosed BPV embodiments, the two terminal end portions 403*c* in the disclosed AVBPV 403 may not be coaxially aligned, as a result of their vertical and horizontal offsets with relation to each other. This in turn results in the central body portion 403*b* being diagonally disposed between the two terminal end portions 403*c* of the AVBPV 403. While the AVBPV 403 of FIG. 4 may exhibit several structural differences when compared to the FVBPV 302 of FIG. 3, both embodiments may be described similarly in terms of which elements are interconnected. As can be seen in FIG. 4, while the central body portion 403*b* is still centrally disposed between and suitably associated with the two terminal end portions 403*c*, the elevation of the of the terminal end portions 403*c* are different. Additionally, the structure and size of each terminal end portion 403*c* may limit the amount and orientation of the adapter ports 403*f* disposed within them. For example, the surface of the terminal end portion 403*c* that is directed toward a support structure may not be capable of engaging with a ventilation system, due to being obstructed by the support structure it bypasses. In alternative embodiments, the size of the terminal end portions (e.g., the height of the terminal end portions 403*c* of FIG. 4) may be increased in order to accommodate the presence of an adapter port within the enlarged surfaces of the terminal end portions 403*c*. Additional modifications may also be realized from the disclosure provided within this application, such as utilizing a branched central body portion 403*b* configured to facilitate more than two terminal end portions 403*c* on the same AVBPV 403.

Figure 5A:
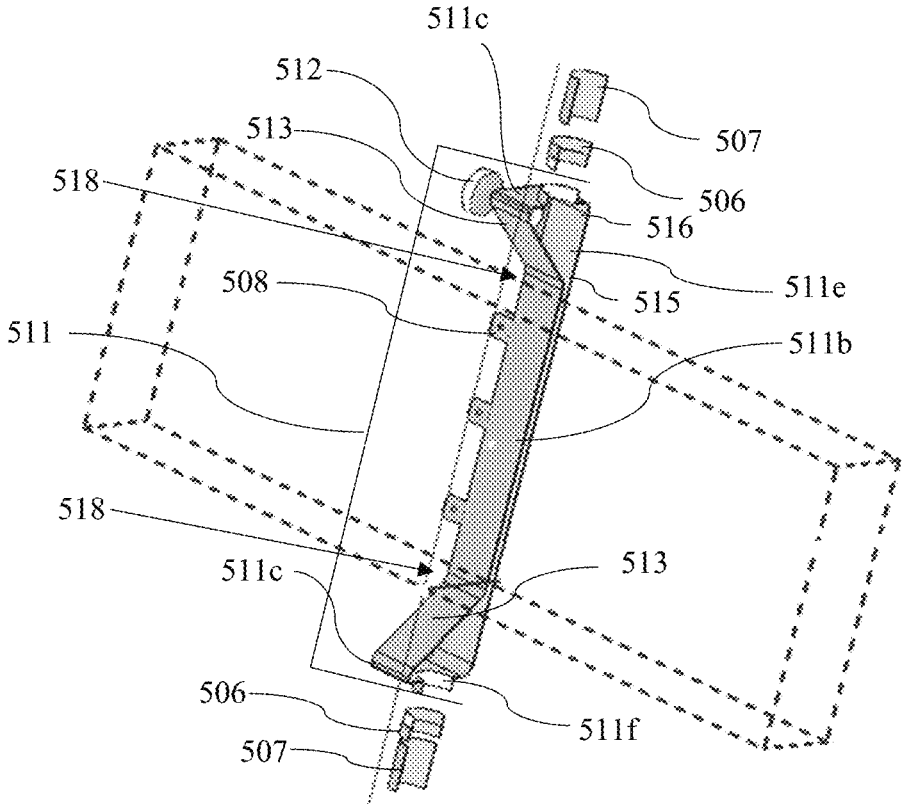
FIG. 5A illustrates the sectional, exploded view of an alternative horizontal beam pass vent, according to an aspect.
Figure 5B:
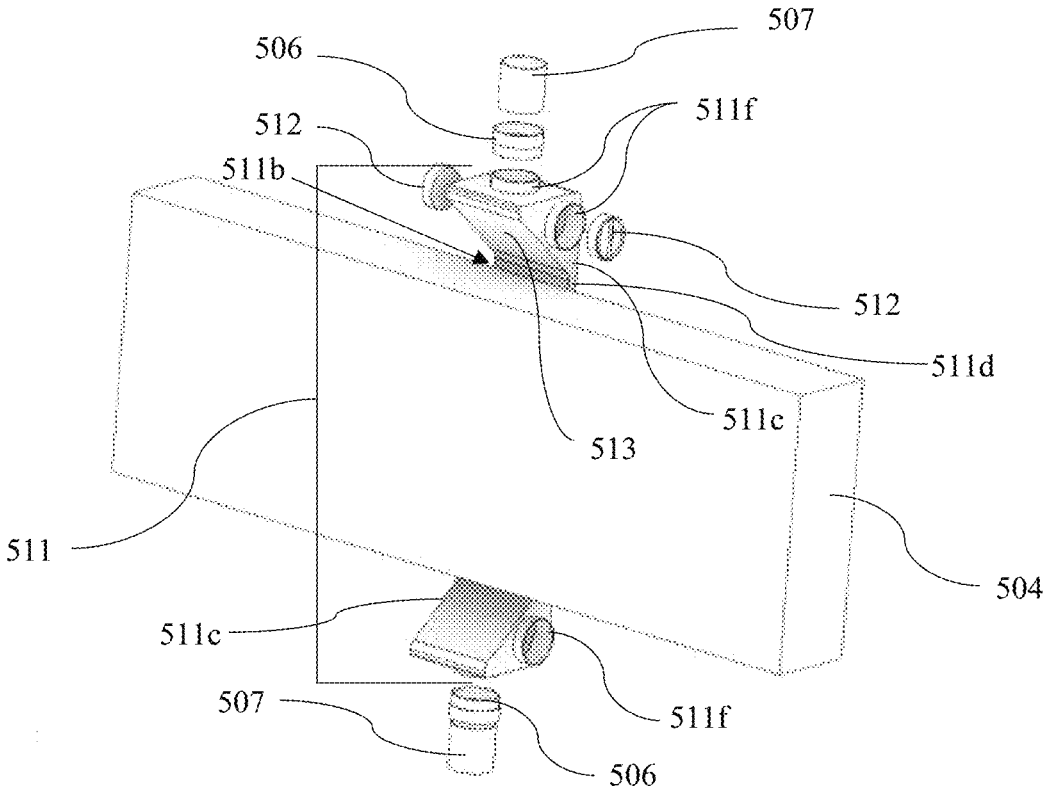
FIG. 5B illustrates the exploded view of an alternative beam pass vent engaging with a beam, according to an aspect.

FIG. 5A illustrates the sectional, exploded view of an alternative horizontal beam pass vent 511, according to an aspect. FIG. 5B illustrates the exploded view of an alternative beam pass vent 511 engaging with a beam 504, according to an aspect. While the overall shape and structure of the disclosed alternative HBPV 511 of FIG. 5A-5B may appear to be mostly similar to that of the HBPV 201 of FIG. 2A-2D, the herein described alternative HBPV 511 may exhibit certain advantages over the latter. The structure the central body portion 511*b* and the corresponding lateral ends 511*d* of the alternative HBPV 511 may be nearly the same as those described in FIG. 2A-2B. However, the shape of the terminal end portions 511*c* of the alternative HBPV 511 is notably different from those of the prior disclosed BPVs.

The terminal end portions 511*c* of the alternative HBPV 511 may have a tapered shape as the result of an angled inner wall ("tapered surface") 513 disposed on the inner surface of each terminal end portion 511*c*. The tapered shape may be oriented such that the narrow end 515 of each tapered terminal end portion 511*c* may engage with or directly attach to an opposite end 518 of the central body portion 511*b*, and the wide end 516 may be disposed at the opposing end of said tapered terminal end portion 511*c*. One benefit of the tapered shape of these tapered terminal end portions 511*c* is the fact that air traveling through the alternate beam pass vent 511 may have improved flow as a result of reducing the drag experienced by the air as it transitions between the central body portion 511*b* and the terminal end portions 511*c*, when compared to other previously disclosed embodiments, which may have sharp angles formed between the central body and terminal end portions (such as 90-degree angle junction formed between the central body portion and each terminal end portion). This reduced drag may thus help minimize the pressure losses that may result from such a bypass device without significantly complicating its design.

Each terminal end portion 511*c* may have more than one adapter port 511*f* nested within it, wherein each adapter port 511*f* may be disposed on a differently oriented surface of each terminal end portion 511*c*. As such, each adapter port 511*f* nested within a terminal end portion 511*c* may be oriented in a different direction such that differently oriented ventilation lines may be configured to engage with correspondingly oriented adapter ports 511*f*. For example, a vertically oriented adapter port 511*f* disposed at a top part of a AVBPV 511 may be configured to engage with a vertically oriented ventilation line, such as ventilation line 507 of FIG. 5A-5B. This feature may allow a singular style of BPV to accommodate various potential configurations of ventilation system. As disclosed previously, each ventilation line adapter 506 is configured to engage with each tapered terminal end portion 511*c* by nesting within a corresponding adapter port 511*f*. Otherwise, any adapter ports 511*f* that are not utilized (e.g., that are not engaged with a ventilation line adapter 506 and/or ventilation line 507, "unutilized adapter ports") may engage with a port cap 512 in order to prevent breaches of the ventilation system into the surrounding area.

By covering unused adapter ports 511*f*, the resultant pressure losses that result from this beam pass vent 511 may be further minimized. The utilization of multiple adapter ports 511*f* and port caps 512 used to cover unutilized adapter ports 511*f* may allow the disclosed alternative HBPV 511 of FIGS. 5A-5B to be easily utilized to allow a ventilation system to bypass beams 504 while in the orientation depicted in FIGS. 5A-5B, or posts when oriented similarly to the FVPBV 302 of FIG. 3. Many other features, such as the hollow inner body 511*e* of the alternative HBPV 511 and the utilization of screw plates 508 to secure the alternative HBPV 511 to the beam 504 may remain the same as previous embodiments. While only three screw plates 508 may be visible from the visible half of the alternative HBPV 511, it should be understood that said alternative HBPV 511 may be symmetrical, having a total of six screw plates 508. Furthermore, each tapered terminal end 511*c* may have three total adapter ports for a total six adapter ports per alternative HBPV 511.

In an embodiment, the alternative HBPV 511 may have two terminal end portions 511*c*. Each terminal end portion 511*c* may be configured to engage with a singular ventilation line adapter 506 by nesting a ventilation line adapter 506 within the corresponding adapter port 511*f*. Each ventilation line adapter 506 in turn engages with a singular ventilation line 507 such that the alternative HBPV engages with two ventilation line adapters 506 and thus two ventilation lines 507. Such an alternative HBPV embodiment may utilize a plurality of port caps 512 to cover its plurality of unutilized adapter ports 511*f*, such that each port cap 512 covers a singular unutilized adapter port 511*f*. It should be understood that an alternative HBPV 511, or any other BPV, may be configured to engage with multiple ventilation lines 507 depending on the application of said BPV. The presence of multiple adapter ports 511*f* covered with port caps 512 provides a highly customizable support bypass device which may engage with ventilation lines heading in any practical direction. Additionally, each BPV with multiple adapter ports 511*f* on a terminal end portions 511*c* may behave as a splitter, allowing air to travel between more than two separate ventilation lines 507.

Figure 6A:
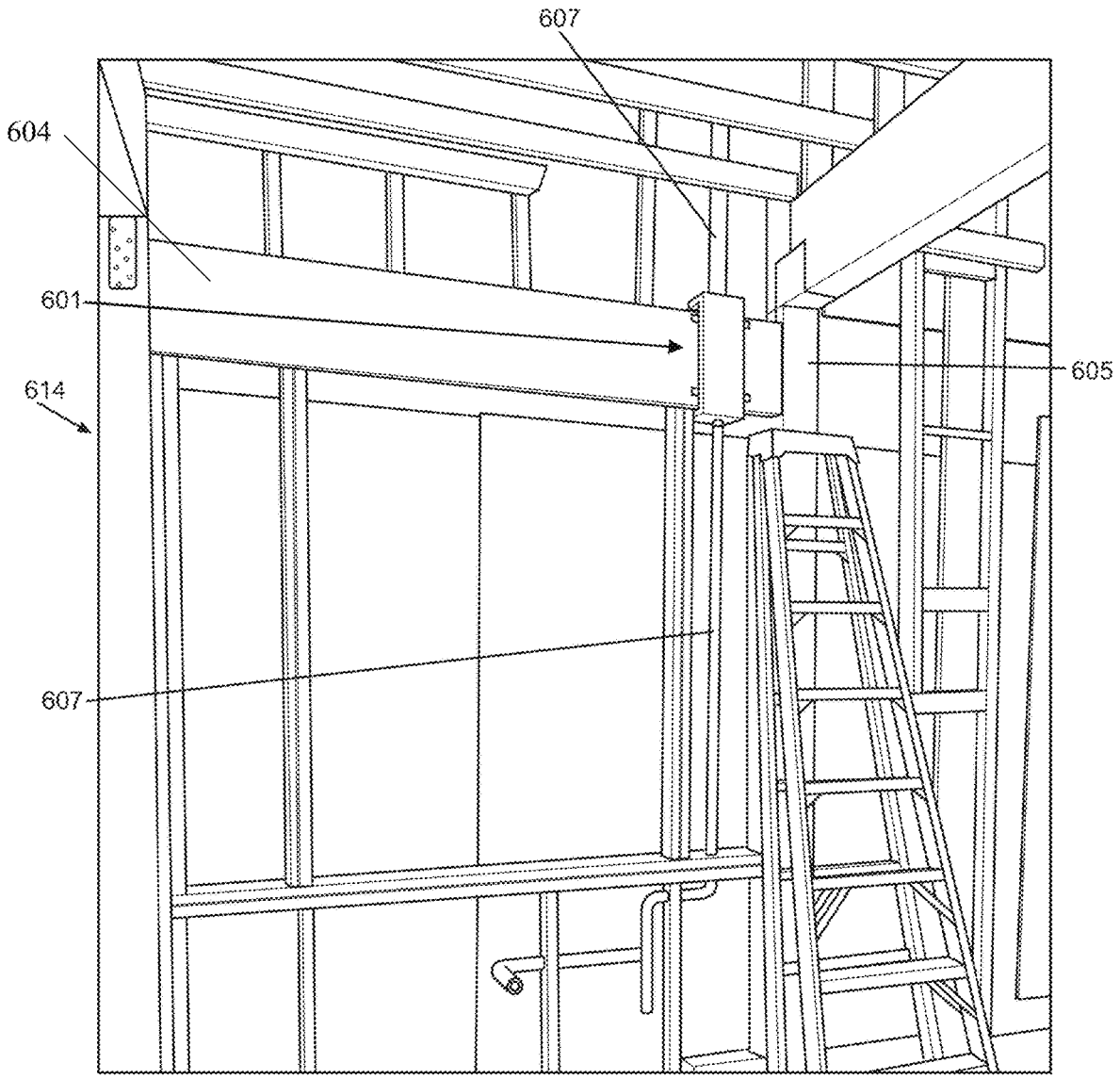
FIGS. 6A-6C illustrate perspective views of exemplary embodiments of the disclosed horizontal beam pass vent installed on the support structure of a building, according to an aspect.
Figure 6B:
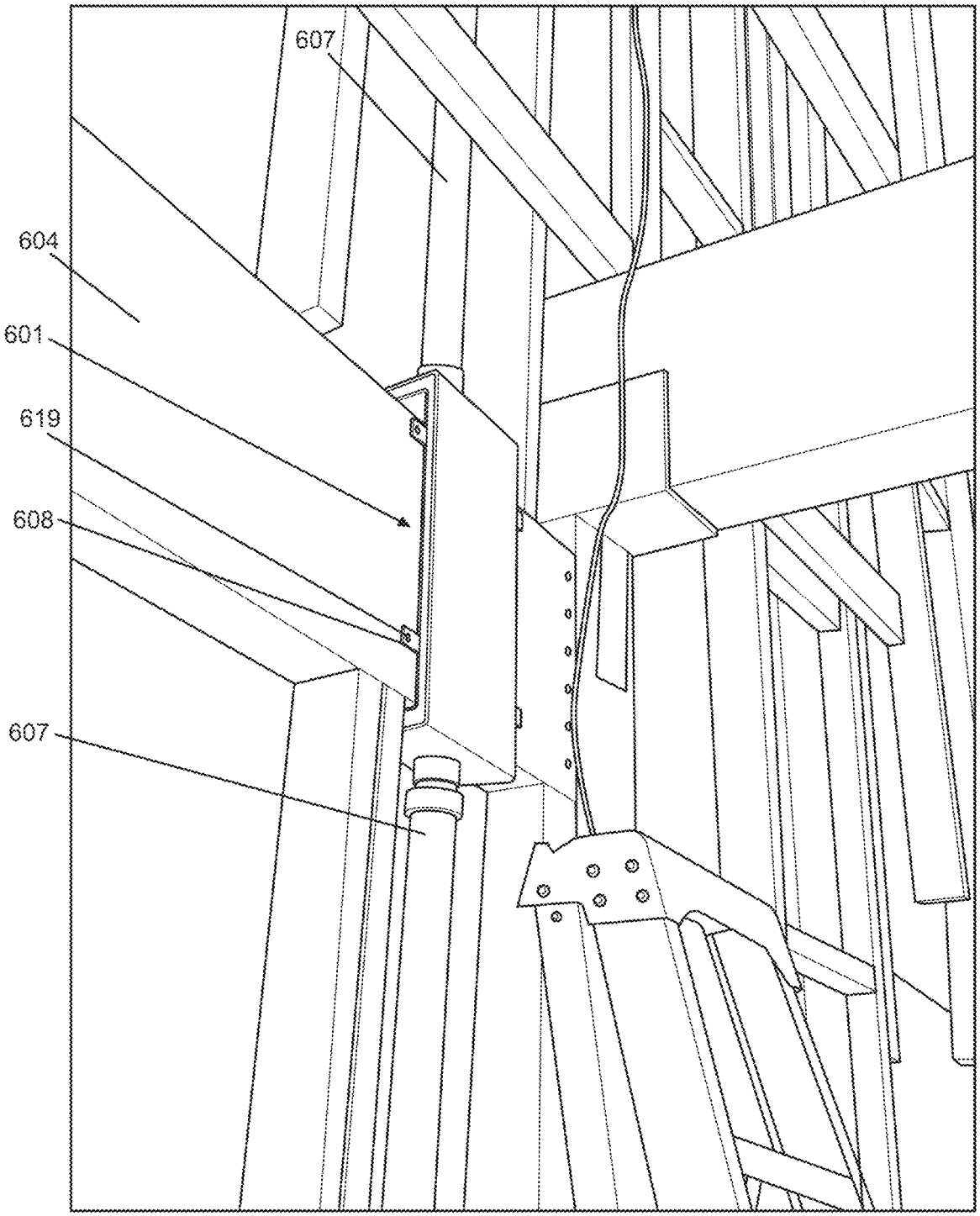
Figure 6C:
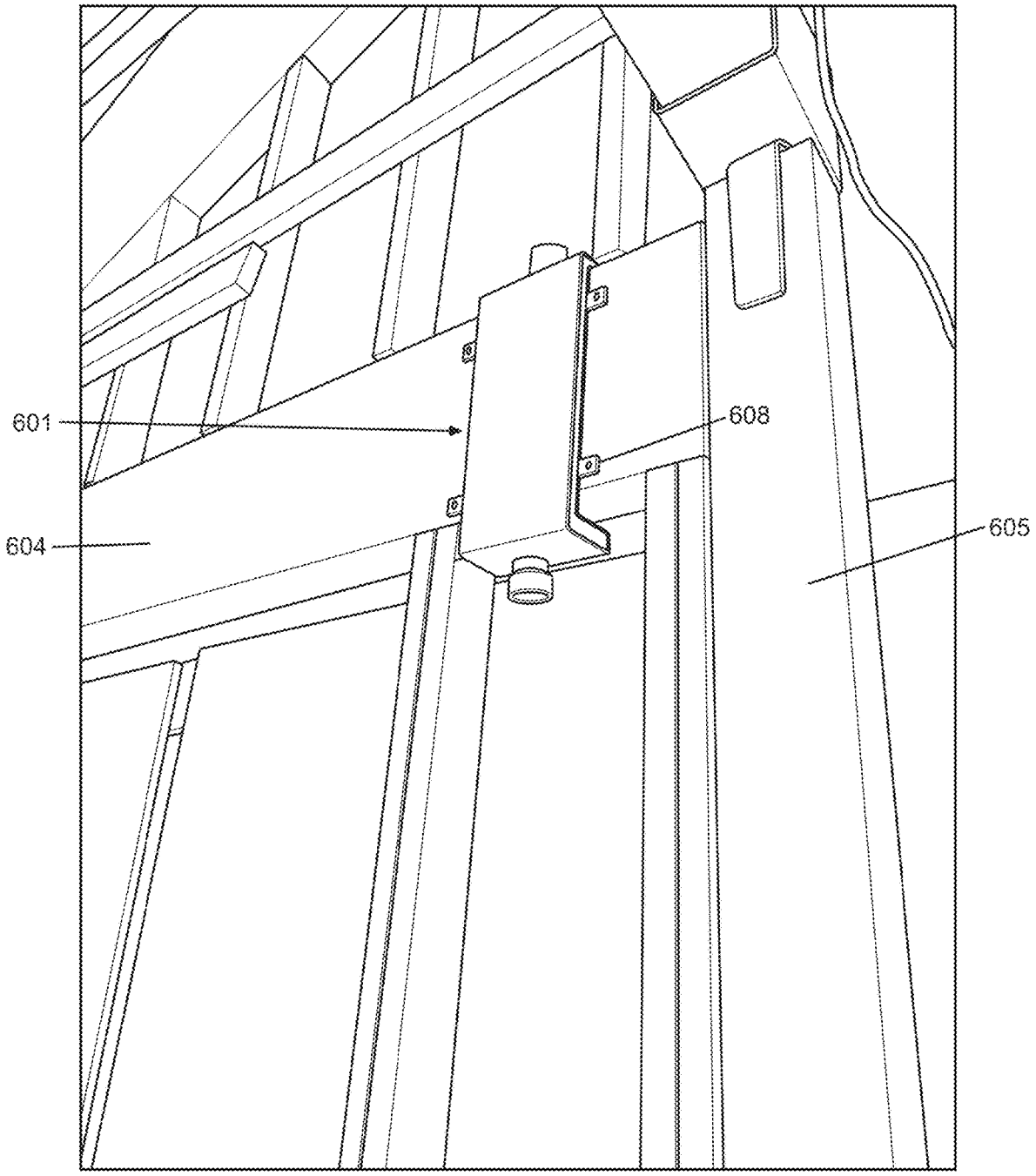

FIGS. 6A-6C illustrate perspective views of exemplary embodiments of the disclosed horizontal beam pass vents 601 installed on the support system 614 of a building, according to an aspect. As can be seen in FIGS. 6A-6C, the disclosed HBPV 601 may be installed on a beam 604 of a support system 614 within a building. It is not necessary for the central body portion 601*b* of the HBPV 601 to have the same height as the beam 604, as long as the central body portion 601*b* is sufficiently long enough to engage with the beam as depicted in FIGS. 6B-6C. It may however be necessary for the screw plates 608 extending from the central body portion 601*b* to suitably lay upon the surface of the beam 604, such that a securing screw 619 inserted through the screw port of each screw plates 608 may be drilled into said beam 604 to secure the HBPV 601 to said beam 604 and thus the support system 614. As described hereinabove, any type of BPV (HBPV 601, the alternative HBPV 511 of FIGS. 5A-5B, the FVBPV 302 of FIG. 3, etc.) may be installed on any type of support structure (beams 604, posts 605, etc.), as long as the ventilation lines 607 are suitably positioned to enter the BPV through its corresponding adapter ports using a corresponding ventilation line adapter. For example, horizontally running ventilation lines may engage with a HBPV 601 that is configured and oriented to bypass a post 605.

Figure 7A:
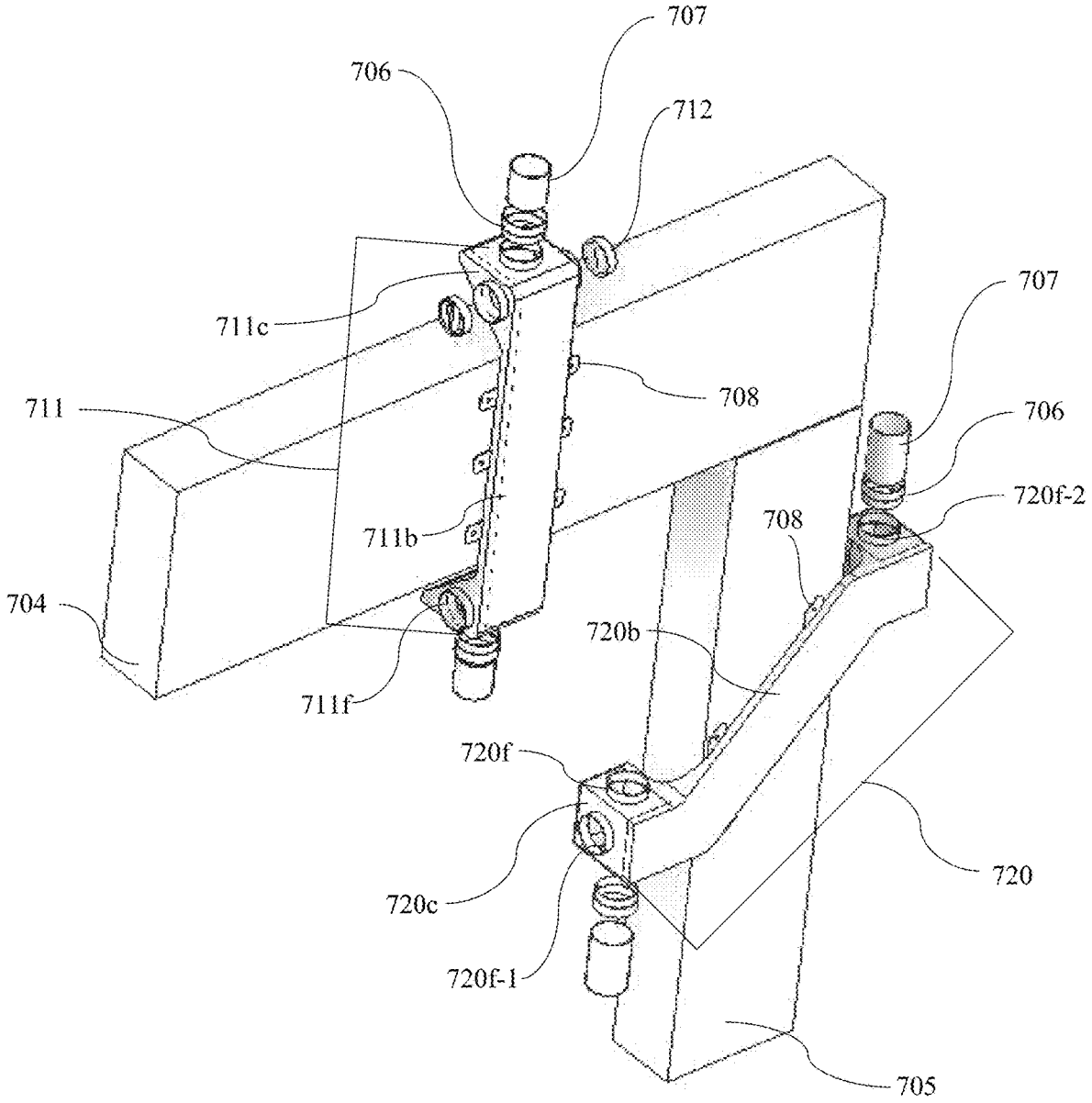
FIG. 7A-7B illustrate top perspective and front views, respectively, of alternative embodiments of the horizontal beam pass vent and angled vertical beam pass vents, according to an aspect.
Figure 7B:
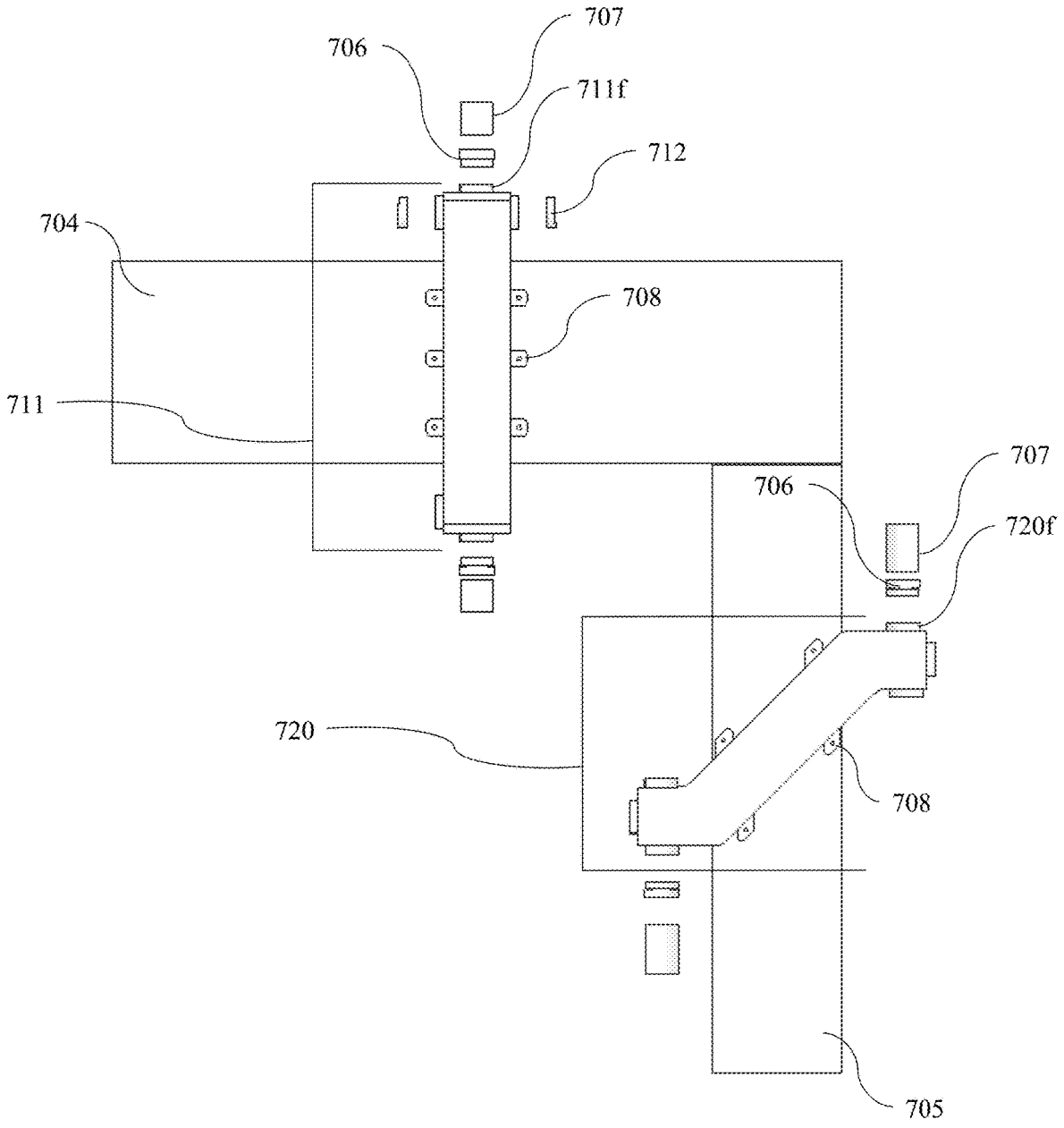
Figure 7C:
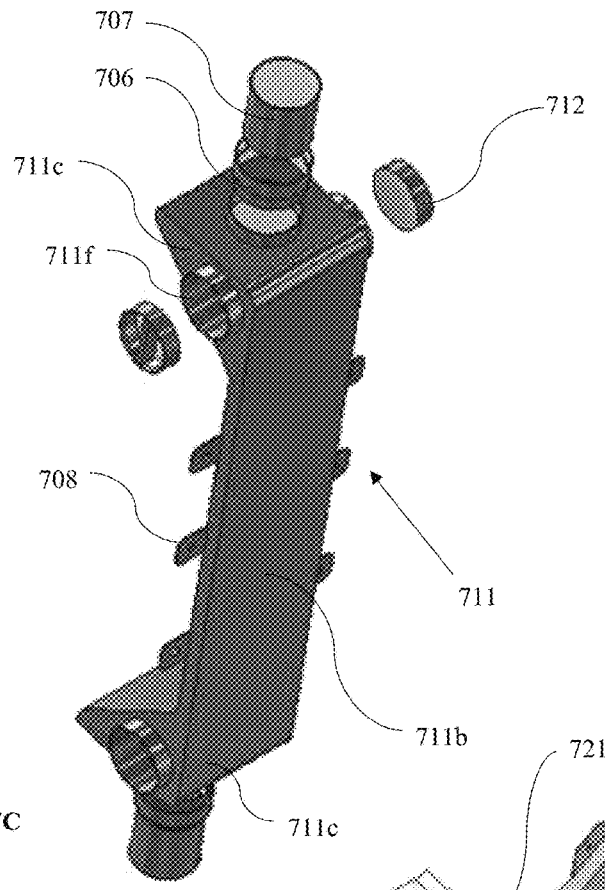
FIG. 7C-7D illustrate the top perspective views of an alternative horizontal beam pass vent and an alternative angled vertical beam pass vent, respectively, according to an aspect.
Figure 7D:
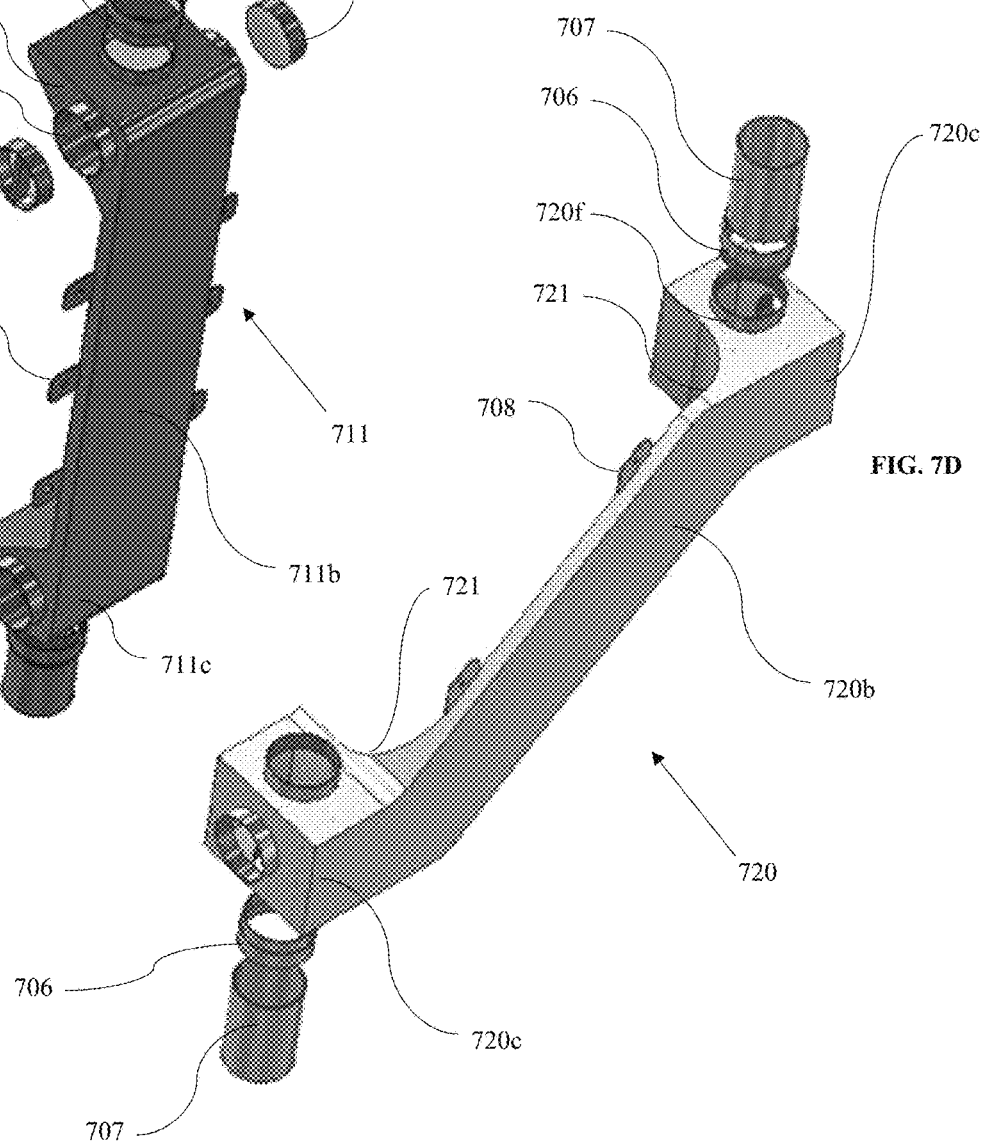

FIG. 7A-7B illustrate top perspective and front views, respectively, of alternative embodiments of the horizontal beam pass vent 711 and angled vertical beam pass vents 720, according to an aspect. FIG. 7C-7D illustrate the top perspective views of an alternative horizontal beam pass vent 711 and an alternative angled vertical beam pass vent 720, respectively according to an aspect. As can be seen in FIGS. 7A-7B, improvements applied to the horizontal beam pass vent 101 of FIG. 1 to produce the alternative horizontal beam pass vent 511, 711 of FIG. 5A-5B, 7 may also be applied to the angled vertical beam pass vent 103 of FIG. 1 to produce the alternative angled vertical beam pass vent 720 of FIG. 7A-7B. This alternative angled vertical beam pass vent 720 may utilize smoothed transitions 721 between the central body portion 720*b* and the terminal end portions 720*c* in order to reduce the drag forces experienced by air traveling through said alternative angled vertical beam pass vent 720.

Similarly to the prior disclosed AVBPV 103 of FIG. 1, the alternative AVBPV 720 of FIGS. 7A-7B may also have terminal end portions 720*c* that do not align horizontally (do not have the same vertical offset when installed) or vertically (do not have the same horizontal offset when installed). As a result of this, the body central body portion 720*b* may be angled with respect to the support post 705, such that it is not perpendicular to or parallel with the support post 705, as seen in FIGS. 7A-7B. One consequence of this central body portion 720*b* being angled is that the air may experience less drag as it flows between the angled central body portion 720*b* and certain adapter ports 720*f* of the terminal end portions 720*c*, particularly adapter ports 720*f* that are angled less than 90 degrees away from the angled central body portion 720*b*. such as adapter ports 720*f*-1 and 720*f*-2.

The alternative AVBPV 720 may have a plurality of adapter ports 720*f* nested within each terminal end portion 720*c*, such that air may travel in the necessary direction and through a corresponding ventilation line adapter 706 to enter a ventilation line 707 after bypassing the support post 705. As described previously, this feature may potentially allow the alterative AVPBV 720 to behave as a splitter or merger of ventilation lines 707 within a ventilation system, providing the alterative AVPBV 720 with added functionality, when compared to other previous embodiments. As disclosed previously, any unutilized adapter ports 720*f* may be covered with a port cap 712, such that the travel of air through said unutilized adapter ports may be prevented.

Certain features of both the alternative HBPV 711 and the alternative AVBPV 720 may be the same as their previously disclosed counterparts. Said features may include the usage of screw plates 708 associated with and extending from the central body portion 711*b*, 720*b*, wherein said screw plates 708 function as described herinabove. As described with previous BPV embodiments, each disclosed BPV embodiment may be used to bypass any support structure, such as a beam 704 or a post 705, depending on how said BPV is oriented. For example, the alternative HBPV 711 may be rotated 90 degrees to bypass the post 705, while the alternative AVBPV 720 may be rotated by 90 degrees to bypass the beam 704, as disclosed for their corresponding non-alternative embodiments described hereinabove. Both the alternative HBPV 711 and the alternative AVBPV 720 will be described in greater detail hereinbelow.

The alternative HBPV 711 of FIGS. 7A-7C may be the same as the previously disclosed alternative HBPV 511 of FIGS. 5A-5B. Each terminal end portion 711*c* of the alternative HBPV 711 may be tapered (e.g., be a tapered terminal end portion 711*c*) to minimize the drag experienced by air that is traveling through the alternative HPBV 711. The alternative HPBV 711 may also have three adapter ports 711*f* nested within each terminal end 711*c*, to facilitate multiple possible configurations and splitting/merging capabilities.

The alternative AVBPV 720 of FIGS. 7A-7B, 7D may incorporate the expanded terminal end designs of other embodiments into the structure of an angled vertical beam pass vent, particularly the presence of multiple adapter ports 720*f* associated/nested within each terminal end portion 720*c*. As disclosed hereinabove, the alternative AVBPV 720 and its multiple adapter ports 720*f* may allow for air currents to be merged or split as necessary, while also allowing air to travel in the necessary direction after bypassing a corresponding support. The smoothed transitions 721 between each terminal end portion 720*c* and the central body portion 720*b* allows for the drag forces experienced by air traveling through the alternative AVPBV 720 to be minimized, thus allowing for the resultant pressure drop experienced by using the disclosed alternative AVBPV 720 to be minimized accordingly.

Depending on the application of the beam bypass vent, either the disclosed alternative HBPV 710 or the alternative AVBPV 720 may be preferred. If a beam bypass vent is attempting to bypass a horizontal beam 704 while maintaining the vertical displacement of the terminal end portions 711*c* (e.g., traveling in a straight line through the central body portion 711*b* and terminal end portions 711*c*), the alternative HBPV 711 may be preferred. If a beam bypass vent is attempting to bypass a post 705 (e.g., move horizontally) while also changing its vertical displacement between the terminal end portions 720*c*, the alternative AVBPV 720 may be preferred. The direction of desired or preexisting incoming/outgoing ventilation lines 707 may also factor into the decision on which type of beam pass vent to use. For example, if an input ventilation line needs to be coaxially aligned with an output ventilation line, the alternative HBPV may be preferred. In another example, if the ventilation lines 707 at opposing sides of a beam 704 or post 705 need to be at different vertical and horizontal offsets, then the alternative AVBPV 720 may be preferred.

FIGS. 8A-8D illustrate the front, side, bottom and top perspective views, respectively, of the alterative horizontal beam pass vent 811, according to an aspect. The sizing specifications disclosed in FIGS. 8A-8D and FIGS. 9A-9D may serve merely as example embodiments of potential support bypass vents 810, 910, as the sizes of each element of the support bypass vent 810, 910 may be suitably varied based on the size of the beam 804 being bypassed, required air flow rate, available ventilation line adapters, etc. In hereinbelow described embodiment, each ventilation line 807 may have a 2 inch diameter that is configured to engage with the ventilation line adapter 806 by being snuggly nested within a ventilation line slot 806*b* having a 2 inch diameter. The pass vent adjoining portion 806*a* of the ventilation line adapter 806 may be suitably configured to be properly engaged with a 2 inch diameter adapter port 811*f* to facilitate engagement between the ventilation line 807 and the alternative horizontal beam pass vent 811. Both the tapered terminal end portions 811*c* and the central body 811*b* may have a width of 4 inches, to facilitate a suitable air flow rate through the BPV's hollow center, even within the lesser depth of the central body portion 811*b*. The central body portion 811*b* may be roughly 14 inches tall, such that the tapered terminal end portions 811*c* are roughly 14 inches apart. This size of beam pass vent would be suitable for a beam having a height of 12 inches.

Figure 8A:
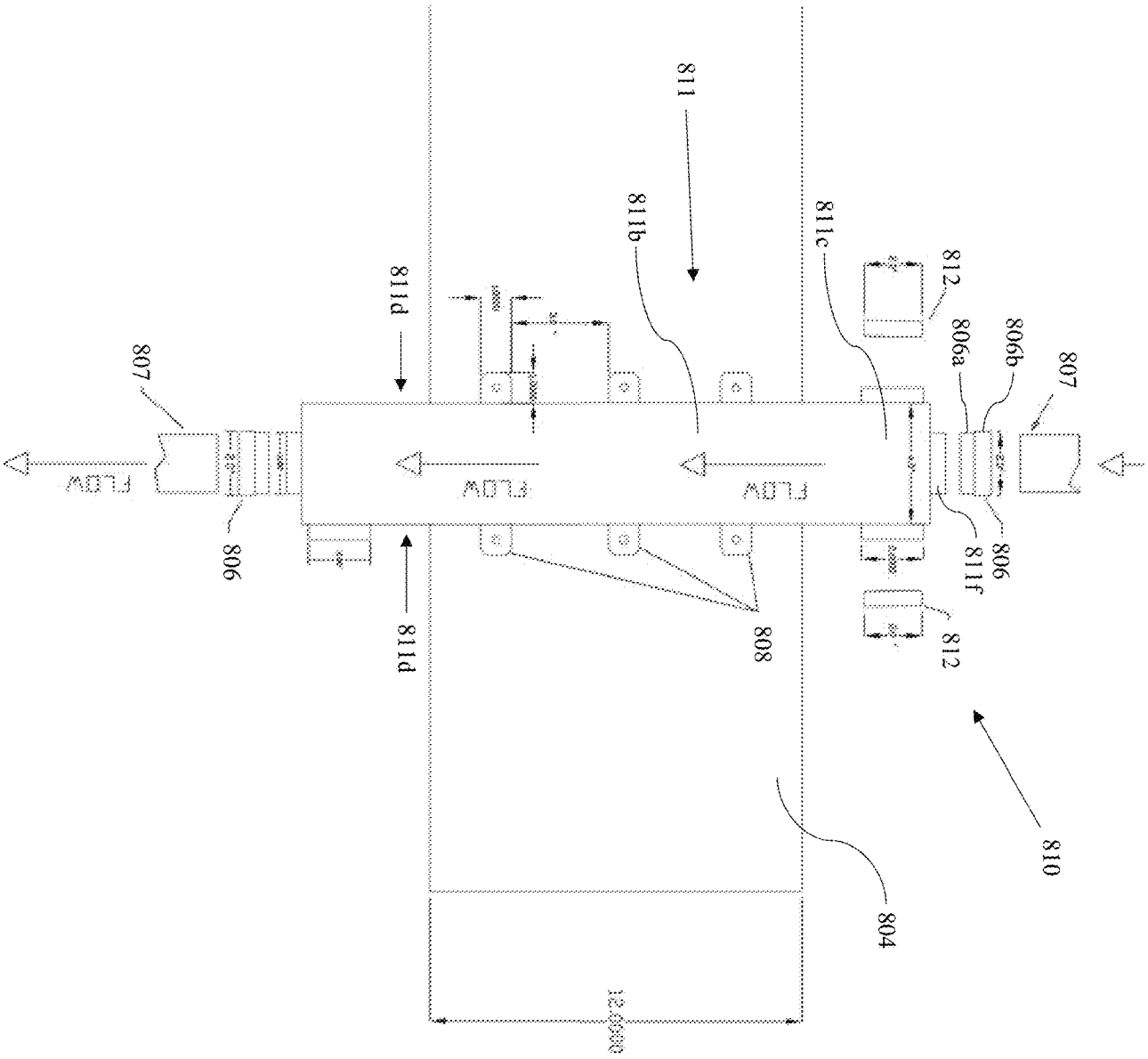
FIGS. 8A-8D illustrate the front, side, bottom and top perspective views, respectively, of an alternative horizontal beam pass vent 811, according to an aspect.
Figure 8B:
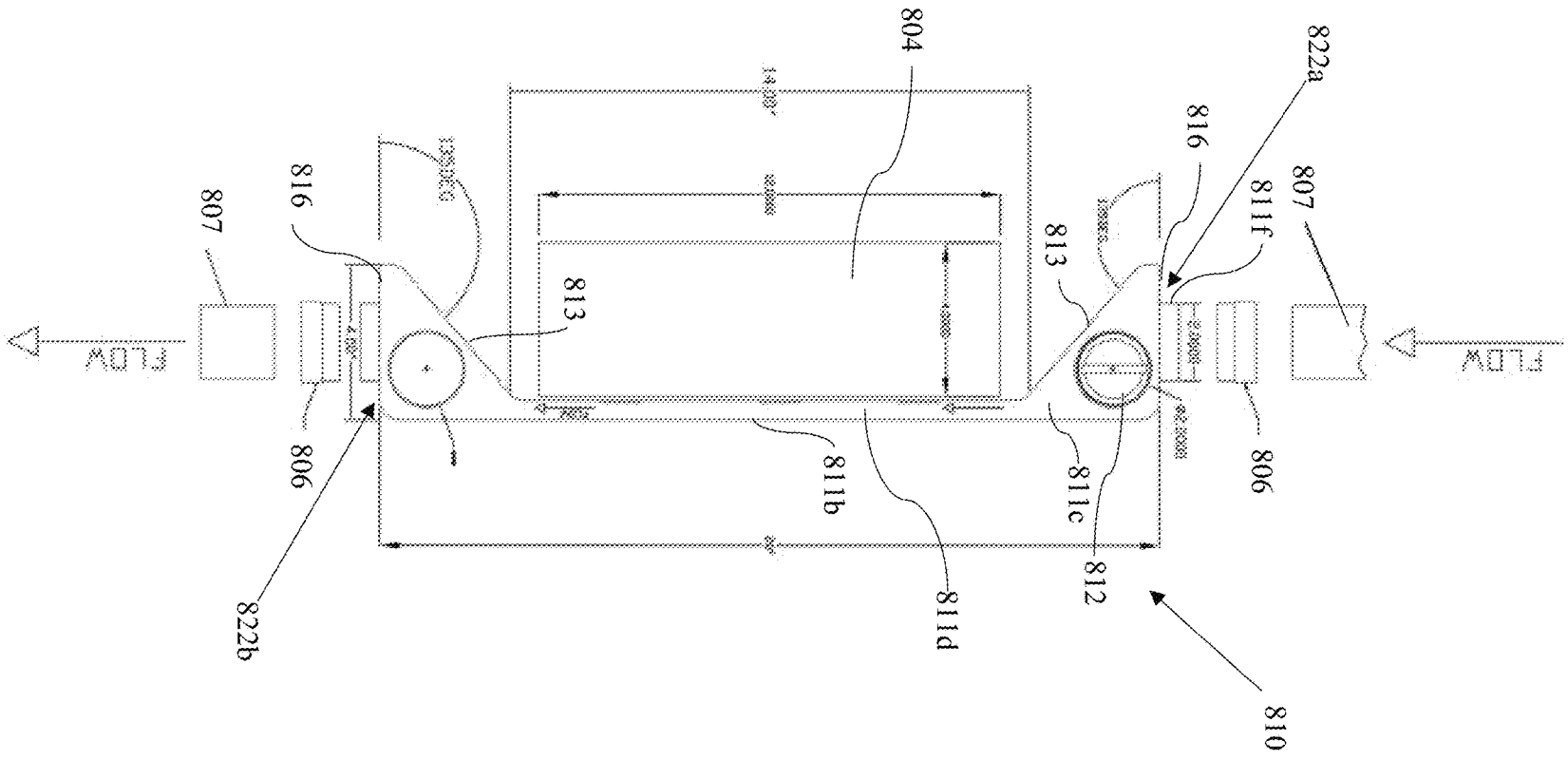
Figure 8C:
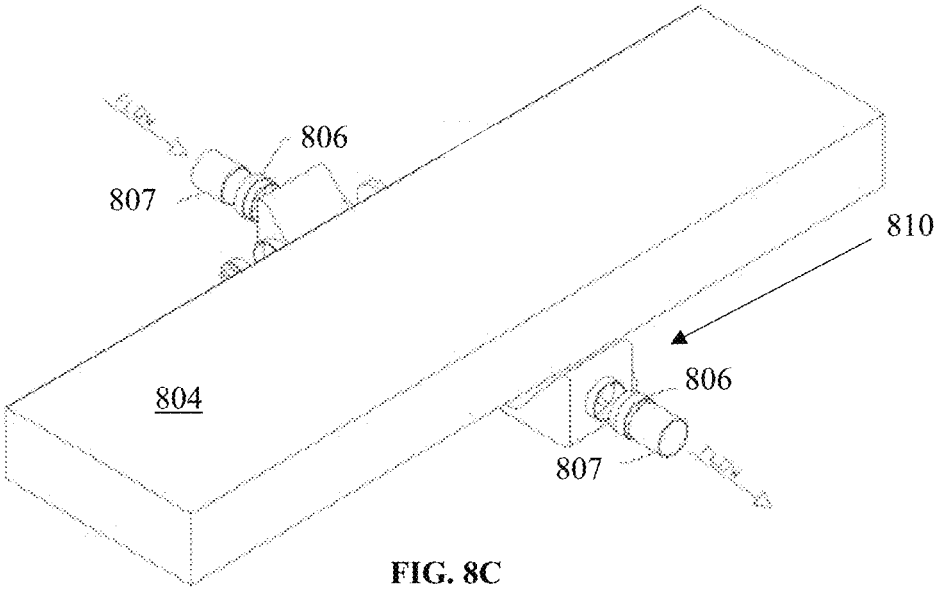
Figure 8D:
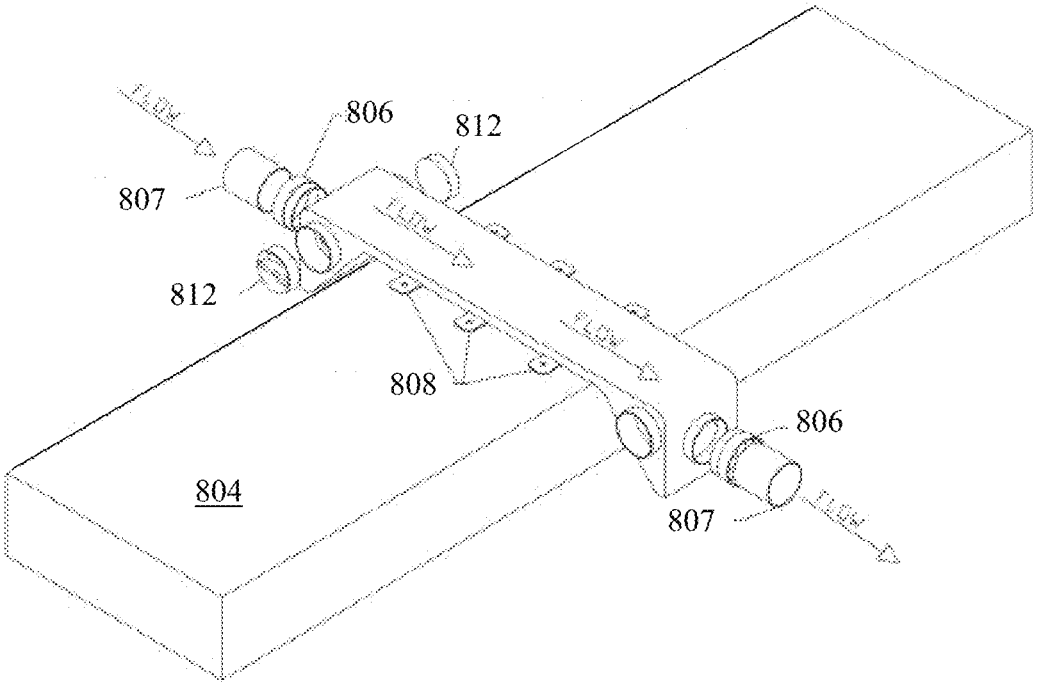

The total height of the alternative horizontal beam pass vent 811 may be about 20 inches, such that the height of each tapered terminal end portion 811*c* is roughly 3 inches. Each terminal end 811*c* may have a depth of 4 inches. The angled inner wall 813 may form a 135-degree angle with the top surface 822*a* of the alternative HBPV 811 (e.g., the top surface 822*a* or bottom surface 822*b* of the top or bottom terminal end portion 811*c*, accordingly), as seen in FIG. 8B, providing a smooth transition between each terminal end portion 811*c* and the central body portion 811*b* for air to travel through. Each port cap 812 may also have a diameter of about 2 inches, wherein said port cap 812 is configured to snuggly engage with a corresponding adapter port 811*f*.

Each screw plate 808 utilized in the alternative HBPV 811 may have a height of 1 inch and a width of 1 inch. The disclosed plurality of screw plates 808 may be arranged on the central body portion 811*b* of the alternative horizontal beam pass vent 811 such that each screw plate 808 attached to a specific lateral end 811*d* of the beam pass vent 811 is separate by a height gap of 3 inches as seen in FIG. 8A. This separation of the screw plates and their disposition on both lateral ends 811*d* of the alternative horizontal beam pass vent 811 allows said beam pass vent 811 to engage with the beam 804 over a sufficiently large area through the utilization of appropriate securing screws (not shown), as disclosed hereinabove. Three screw plates 808 may be secured to each lateral end 811*d* to provide a suitable spread and quantity of engagement points between the beam pass vent 811 and the beam 804.

With regards to the depicted flow arrows, it should be understood that air may travel from the top to the bottom of the beam bypass vent 811, as shown if FIG. 8A-8B, or vice-versa, depending on the intended flow direction for the associated ventilation system.

Figure 9A:
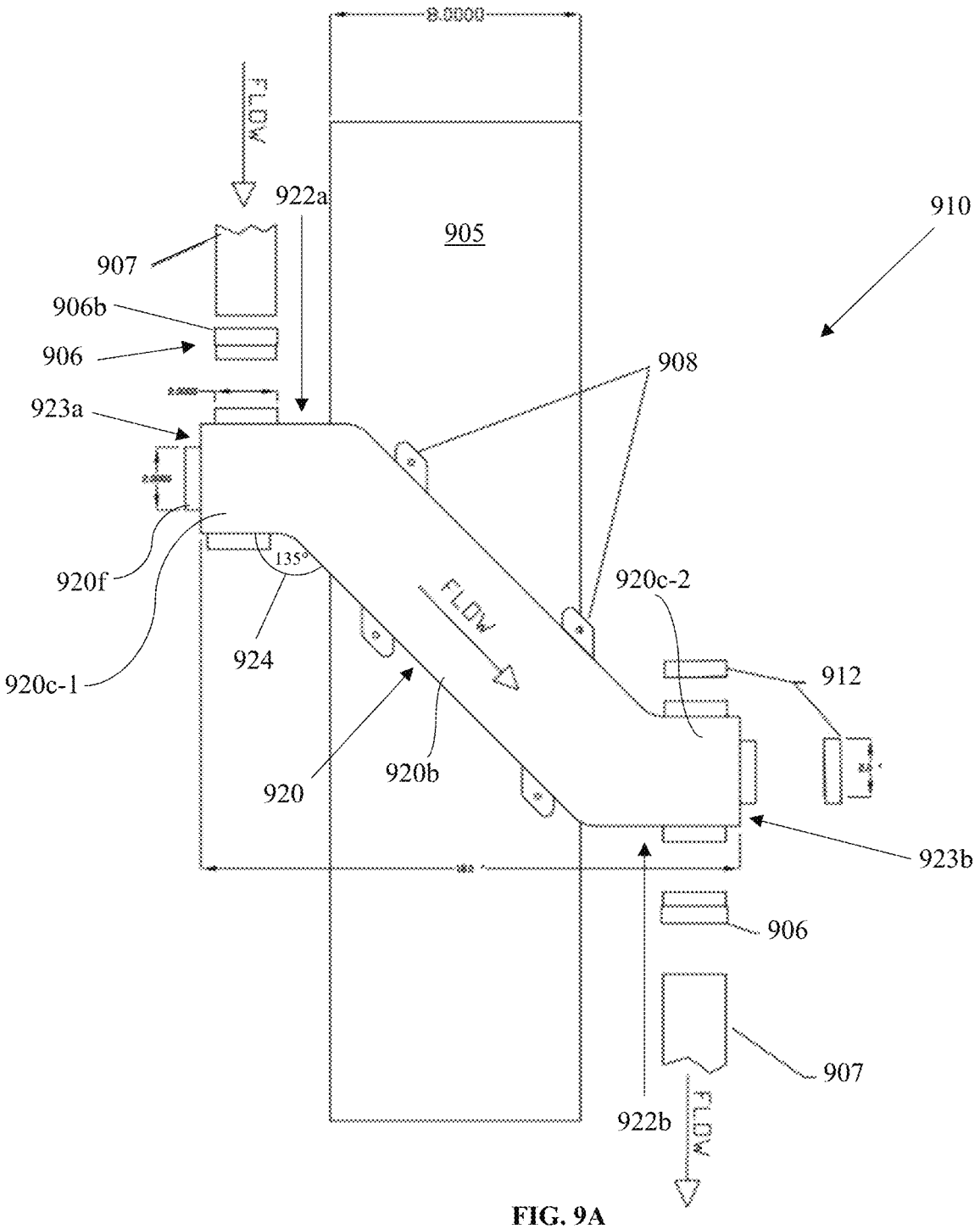
FIGS. 9A-9D illustrate the front, side, bottom and top perspective views, respectively, of an alternative angled vertical beam pass vent, according to an aspect.
Figure 9B:
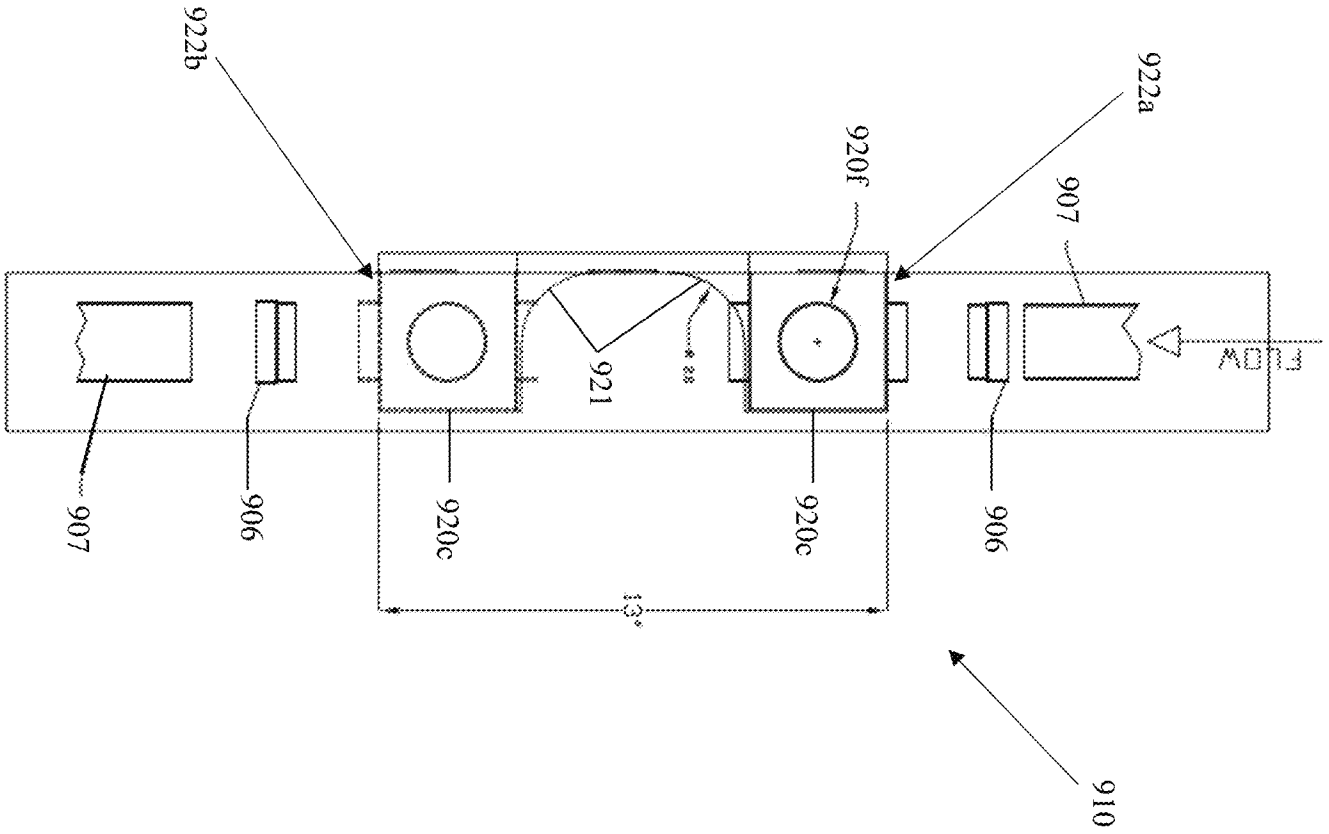
Figure 9C:
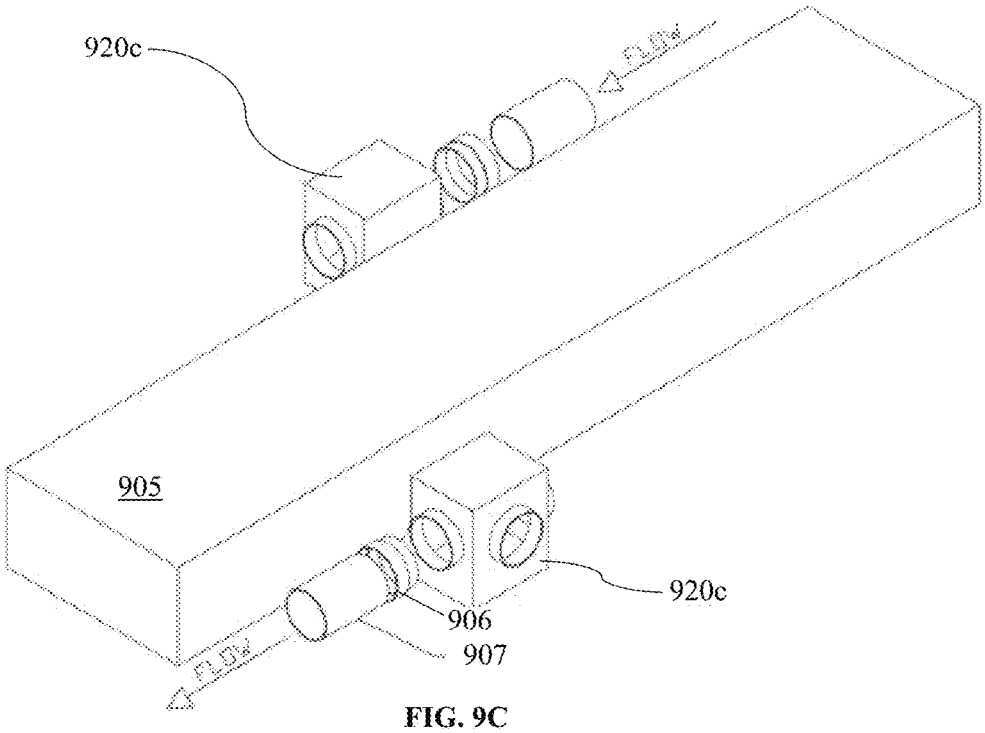
Figure 9D:
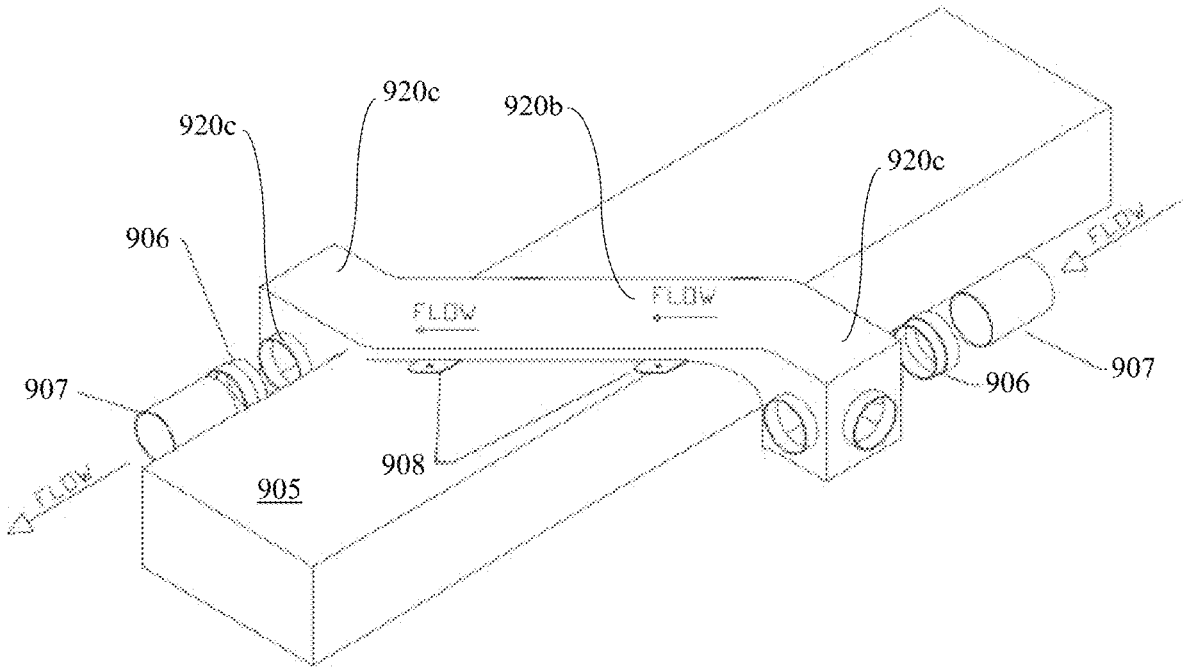

FIGS. 9A-9D illustrate the front, side, bottom perspective and top perspective views, respectively, of the alternative angled vertical beam pass vent 920, according to an aspect. As with the example sizing specifications for the alternative horizontal beam pass vent of FIGS. 8A-8D, each of the radial features, including the ventilation line 907, port cap 912, ventilation line slot 906*b* and adapter port 920*f*, of the herein disclosed example sizing specifications for the alternative angled vertical beam pass vent may have an about 2 inch diameter to facilitate their respective engagements with each other. Additionally, the smoothed transitions 921 disposed between the terminal end portions 920*c* and the central body portion 920*b* may form a radial arch having a 2 inch diameter as well, as illustrated in FIG. 9B. As disclosed previously, this smoothed transition 921 may facilitate a reduced drag force being exerted air traveling between the terminal end portions 920*c* and the central body portion 920*b*, reducing pressure losses caused by the overall support bypass vent 910.

As can be seen from the side view of the alternative AVBPV 920 of FIG. 9A, the transition angle 924 between each terminal end portion 920*c* and the central body portion 920*b* may be about 135 degrees. This transition angle 924 may also work in conjunction with the prior described smoothed transitions 921 to minimize the drag experienced by air traveling through the alternative AVBPV 920. It should be understood that said transition angle 924 is provided purely as an example, as the transition angle 924 may be varied based on the needs of the application.

As disclosed hereinabove, the terminal end portions 920*c* of the alternative AVBPV 920 may be disposed at different heights and lateral positions (when viewed from the front view of FIG. 9A) while said alternative AVBPV 920 is engaged with a post 905 or beam, as a result of the angled orientation of the central body portion 920*b*. The left surface 923*a* of the alternative AVBPV 920 may be laterally offset from the right surface 923*b* of said alternative AVBPV 920 by about 18 inches. Additionally, as can be seen in FIG. 9B, the top surface 922*a* of the alternative AVBPV 920 may be vertically offset from the bottom surface 922*b* of the alternative AVBPV 920 by about 13 inches. As can be seen in FIG. 9A, the left surface 923*a* and the top surface 922*a* may both be disposed on a first terminal end portion 920*c*-1, whereas the right surface 923*b* and bottom surface 922*b* may both be disposed on a second terminal end portion 920*c*-2.

Aside from the hereinabove discussed features, the disclosed alternative AVBPV 920 may be similar to the alternative HBPV 811 of FIGS. 8A-8D. Each terminal end portion 920*c* may have a plurality of adapter ports 920*f*, each of which is configured to engage with a ventilation line adapter 906 or a port cap 912, depending on the desired flow air flow direction. Each ventilation line adapter 906 may engage with a ventilation line 907 through utilization of the corresponding ventilation line slot 906*b*. The screw plates 908 may be associated with the central body portion 920*b* and configured to engage with a post 905 or beam through the utilization of securing screws (not shown). The example BPV embodiments 811, 920 of FIGS. 8A-8D and FIGS. 9A-9D, respectively, may also have a wall thickness of ⅛" and central body portion 811*b*, 920*b* depth of no more than ½", as disclosed hereinabove. Other wall thicknesses and central body portion depths may also be utilized depending on the application.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A support bypass vent comprising:

a beam pass vent having:

a central body portion having two opposite ends and a hollow inner cavity disposed between the two opposite ends;

two tapered terminal end portions, each tapered terminal end portion having a narrow end directly attached to the corresponding opposite end of the central body portion, wherein each tapered terminal end portion is angled with respect to the central body portion;

a plurality of screw plates associated with the central body portion, wherein each screw plate is configured to house a securing screw, wherein each securing screw is configured to secure the beam pass vent to a support structure;

a plurality of adapter ports nested within each tapered terminal end portion, wherein an adapter port of the plurality of adapter ports nested within each tapered terminal end portion is configured to be coaxially aligned with a corresponding adapter port of the plurality of adapter ports nested within the other tapered terminal end portion; and two ventilation line adapters, each ventilation line adapter being configured to engage with a corresponding tapered terminal end portion by being nested within a corresponding adapter port of the corresponding plurality of adapter ports;

wherein each ventilation line adapter is further configured to engage with a corresponding ventilation line.

2. The support bypass vent of claim 1, further comprising a plurality of port caps, wherein each port cap is configured to cover a corresponding adapter port of the pluralities of adapter ports that is not engaged with a corresponding ventilation line adapter of the two ventilation line adapters.

3. The support bypass vent of claim 1, wherein the tapered shape of each tapered terminal end portion is configured to reduce the pressure drop experienced by air flowing through the support bypass vent.

4. The support bypass vent of claim 1, wherein the central body portion comprises a first set of parallel faces and a second set of parallel faces that adjoin the first set of parallel faces to form a rectangular pipe.

5. The support bypass vent of claim 4, wherein the first set of parallel faces are less than one half inch apart.

6. The support bypass vent of claim 5, wherein the first set of parallel faces are parallel with a surface of the support structure.

7. The support bypass vent of claim 1, wherein the beam pass vent of further comprises a brace plate disposed within the hollow inner cavity and secured to the central body portion.

8. A support bypass vent comprising:

a beam pass vent having:

a central body portion having two opposite ends and a hollow inner cavity disposed between the two opposite ends;

a terminal end portion associated with each opposite end of the central body portion, such that the beam pass vent comprises two terminal end portions, wherein each terminal end portion is angled with respect to the central body portion, such that the two terminal end portions are vertically and horizontally offset from each other;

at least one adapter port nested within each terminal end portion; and a ventilation line adapter configured to engage with each terminal end portion by engaging with a corresponding adapter port;

wherein each ventilation line adapter is further configured to engage with a corresponding ventilation line.

9. The support bypass vent of claim 8, wherein the said support bypass vent is configured to allow a ventilation system to bypass a support structure without damaging the support structure.

10. The support bypass vent of claim 8, wherein each ventilation line adapter comprises a threaded protrusion configured to nest within and engage with a corresponding adapter port having a complementary nested thread.

11. The support bypass vent of claim 10, wherein each ventilation line adapter further comprises a ventilation line slot configured to engage with a corresponding ventilation line through compression of the ventilation line within the ventilation line slot.

12. The support bypass vent of claim 8, wherein the beam pass vent forms a concave shape configured to conform around the shape of a support structure.

13. The support bypass vent of claim 8, wherein the support bypass vent is made of acrylonitrile-butadiene-styrene.

14. A support bypass vent comprising:

a beam pass vent having:

a central body portion having two opposite ends and a hollow inner cavity disposed between the two opposite ends;

a terminal end portion associated with each opposite end of the central body portion, wherein each terminal end portion is angled with respect to the central body portion; and a threaded adapter port associated with each terminal end portion;

wherein each adapter port is configured to engage with a corresponding ventilation line adapter.

15. The support bypass vent of claim 14, wherein each adapter port comprises an internally nested thread configured to engage with the corresponding ventilation line adapter.

16. The support bypass vent of claim 14, wherein the support bypass vent is configured to engage with a support structure.

17. The support bypass vent of claim 14, wherein a 90-degree angle is formed between the central body portion and each terminal end portion.

18. The support bypass vent of claim 14, wherein the support bypass vent is configured to engage with at least two ventilation lines.

19. The support bypass vent of claim 18, wherein the support bypass vent is made of the same material as the ventilation lines.

* * * * *